US010580362B2

(12) United States Patent
Park et al.

(10) Patent No.: US 10,580,362 B2
(45) Date of Patent: Mar. 3, 2020

(54) DISPLAY DEVICE

(71) Applicant: Samsung Display Co., Ltd., Yongin-si, Gyeonggi-do (KR)

(72) Inventors: Yong Sung Park, Yongin-si (KR); Min Woo Byun, Yongin-si (KR); Kwang Chul Jung, Yongin-si (KR); Hyun Joon Kim, Yongin-si (KR); Sung Yoon Kim, Yongin-si (KR); Hyun Suk Yang, Yongin-si (KR); Doo Youl Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/052,402

(22) Filed: Aug. 1, 2018

(65) Prior Publication Data

US 2019/0130840 A1 May 2, 2019

(30) Foreign Application Priority Data

Nov. 2, 2017 (KR) ..... 10-2017-0145459

(51) Int. Cl.
*G09G 3/3266* (2016.01)

(52) U.S. Cl.
CPC ... *G09G 3/3266* (2013.01); *G09G 2300/0426* (2013.01); *G09G 2310/0232* (2013.01); *G09G 2310/0281* (2013.01); *G09G 2320/0223* (2013.01); *G09G 2320/0233* (2013.01); *G09G 2330/04* (2013.01)

(58) Field of Classification Search
CPC .. G09G 3/3225; G09G 3/3233; G09G 3/3266; G09G 3/3648; G09G 2300/0439; G09G 2300/0842; G09G 2310/0251; G09G 2310/0286; G09G 2310/08; G09G 2320/0223; G09G 2320/023; G09G 2300/0426; G09G 2310/0232; G09G 2310/0281; G09G 2320/0233; G09G 2330/04
See application file for complete search history.

(56) References Cited

U.S. PATENT DOCUMENTS

2017/0039936 A1 2/2017 Byun et al.
2017/0155245 A1 6/2017 Kim et al.
(Continued)

FOREIGN PATENT DOCUMENTS

KR 10-1376654 B1 3/2014
KR 10-2017-0018156 A 2/2017

*Primary Examiner* — Nelson M Rosario
(74) *Attorney, Agent, or Firm* — Lewis Roca Rothgerber Christie LLP

(57) ABSTRACT

A display device includes: first pixels in a first pixel region and connected to first scan lines; second pixels in a second pixel region that is located at a side of the first pixel region and has a width smaller than a width of the first pixel region, and connected to second scan lines; third pixels in a third pixel region that is spaced apart from the second pixel region and has a width smaller than the width of the first pixel region, and connected to third scan lines; a load matching unit in a peripheral region at an outside of the second pixel region and the third pixel region, and configured to match loads of the second scan lines and the third scan lines to that of the first scan lines; and a protection unit connected between the second and third pixels and the load matching unit.

17 Claims, 10 Drawing Sheets

(56) References Cited

U.S. PATENT DOCUMENTS

| | | | | |
|---|---|---|---|---|
| 2017/0352311 | A1* | 12/2017 | Lee | G09G 3/3225 |
| 2018/0129106 | A1* | 5/2018 | Gao | G02F 1/134363 |
| 2018/0190190 | A1* | 7/2018 | Xi | G09G 3/3225 |

* cited by examiner

DISPLAY DEVICE

CROSS-REFERENCE TO RELATED APPLICATION

This application claims priority to and the benefit of Korean Patent Application No. 10-2017-0145459, filed on Nov. 2, 2017 in the Korean Intellectual Property Office, the entire disclosure of which is incorporated by reference herein.

BACKGROUND

1. Field

Aspects of embodiments of the present disclosure relate to a display device.

2. Description of the Related Art

An organic light emitting display device includes two electrodes and an organic emitting layer located between the two electrodes. In the organic light emitting display device, electrons injected from one electrode and holes injected from the other electrode are combined in the organic emitting layer so as to form excitons, and the excitons emit light through energy emission.

The organic light emitting display device includes a plurality of pixels each including an organic light emitting diode that is a self-luminescent device, and each pixel is provided with lines and a plurality of thin film transistors that are connected to the lines and drive the organic light emitting diode.

Also, the organic light emitting display device includes a scan driver, an emission driver, and a data driver, which are used to drive the pixels.

SUMMARY

According to an aspect of embodiments, a display device is capable of displaying an image with a uniform luminance.

According to another aspect of embodiments, a display device is capable of efficiently using dead spaces.

According to another aspect of embodiments, a display device is protected from electrostatic discharge.

According to one or more embodiments of the present disclosure, a display device includes: first pixels in a first pixel region, the first pixels being connected to first scan lines; second pixels in a second pixel region that is located at a side of the first pixel region and has a width smaller than a width of the first pixel region, the second pixels being connected to second scan lines; third pixels in a third pixel region that is spaced apart from the second pixel region and has a width smaller than the first pixel region, the third pixels being connected to third scan lines; a load matching unit located in a peripheral region at an outside of the second pixel region and the third pixel region, the load matching unit configured to match loads of the second scan lines and the third scan lines to that of the first scan lines; and a protection unit in the peripheral region, the protection unit being connected between the second and third pixels and the load matching unit, wherein the protection unit includes first protection lines and second protection lines.

The display device may further include: a first scan driver in a first peripheral region at an outside of the first pixel region, the first scan driver configured to supply a first scan signal to the first scan lines; a second scan driver in a second peripheral region at the outside of the second pixel region, the second scan driver configured to supply a second scan signal to the second scan lines; and a third scan driver in a third peripheral region at an outside of the third pixel region, the third scan driver configured to supply a third scan signal to the third scan lines. The second pixels may be connected between the second scan driver and the load matching unit, and the third pixels may be connected between the third scan driver and the load matching unit.

The load matching unit may include: first load matching units in the second peripheral region, the first load matching units being electrically connected to some of the second scan lines; second load matching units in the third peripheral region, the second load matching units being electrically connected to some of the third scan lines; and third load matching units in a fourth peripheral region connecting the second peripheral region and the third peripheral region, the third load matching units being electrically connected to other ones of the second scan lines and other ones of the third scan lines.

Some of the first protection lines may be between the first load matching units and the second pixels, and other ones of the first protection lines may be between the third load matching units and the second pixels.

Some of the second protection lines may be between the second load matching units and the third pixels, and other ones of the second protection lines may be between the third load matching units and the third pixels.

The first protection lines and the second protection lines may include poly-silicon.

A number of the second pixels located on one horizontal line and a number of the third pixels located on one horizontal line may become smaller at locations more distant from the first pixel region.

The load matching unit may include a first load matching pattern and a second load matching pattern, which form a capacitance therebetween.

A magnitude of the capacitance may become larger at locations more distant from the first pixel region.

According to one or more embodiments of the present disclosure, a display device includes: first pixels in a first pixel region, the first pixels being connected to first scan lines; second pixels in a second pixel region that is located at a side of the first pixel region and has a width smaller than a width of the first pixel region, the second pixels being connected to second scan lines; third pixels in a third pixel region that is spaced apart from the second pixel region and has a width smaller than the width of the first pixel region, the third pixels being connected to third scan lines; a load matching unit located in a peripheral region at an outside of the second pixel region and the third pixel region, the load matching unit configured to match loads of the second scan lines and the third scan lines to that of the first scan lines; and a protection unit in the peripheral region, the protection unit being connected between the second pixels and the load matching unit, the protection unit being connected between the third pixels and the load matching unit, wherein the protection unit includes electrostatic discharge protection circuits.

The electrostatic discharge protection circuits may include first electrostatic discharge protection circuits electrically connected to the second pixels and second electrostatic discharge protection circuits electrically connected to the third pixels.

Each of the first electrostatic discharge protection circuits and the second electrostatic discharge protection circuits may include reverse diode type transistors each having a gate electrode and a first electrode, which are connected to each other.

The load matching unit may include: first load matching units located in the second peripheral region, the first load matching units being electrically connected some of the second scan lines; second load matching units located in the third peripheral region, the second load matching units being electrically connected to some of the third scan lines; and third load matching units located in a fourth peripheral region connecting the second peripheral region and the third peripheral region, the third load matching units being electrically connected to other ones of the second scan lines and other ones of the third scan lines.

Some of the first electrostatic discharge protection circuits may be connected to the first load matching units, and other ones of the first electrostatic discharge protection circuits may be connected to the third load matching units.

Some of the second electrostatic discharge protection circuits may be connected to the second load matching units, and other ones of the second electrostatic discharge protection circuits may be connected to the third load matching units.

The protection unit may further include: first protection lines electrically connected to the first electrostatic discharge protection circuits; and second protection lines electrically connected to the second electrostatic discharge protection circuits.

Some of the first protection lines may be between the first load matching units and the second pixels, and other ones of the first protection lines may be between the third load matching units and the second pixels. Some of the second protection lines may be between the second load matching units and the third pixels, and other ones of the second protection lines may be between the third load matching units and the third pixels.

The first protection lines and the second protection lines may include poly-silicon.

BRIEF DESCRIPTION OF THE DRAWINGS

Some example embodiments will be described more fully herein with reference to the accompanying drawings; however, the present disclosure may be embodied in different forms and should not be construed as limited to the embodiments set forth herein. Rather, these embodiments are provided so that this disclosure will be thorough and complete, and will fully convey the scope of the present disclosure to those skilled in the art.

In the drawing figures, dimensions may be exaggerated for clarity of illustration. It is to be understood that when an element is referred to as being "between" two elements, it may be the only element between the two elements, or one or more intervening elements may also be present. Like reference numerals refer to like elements throughout.

DETAILED DESCRIPTION

Figure 1:
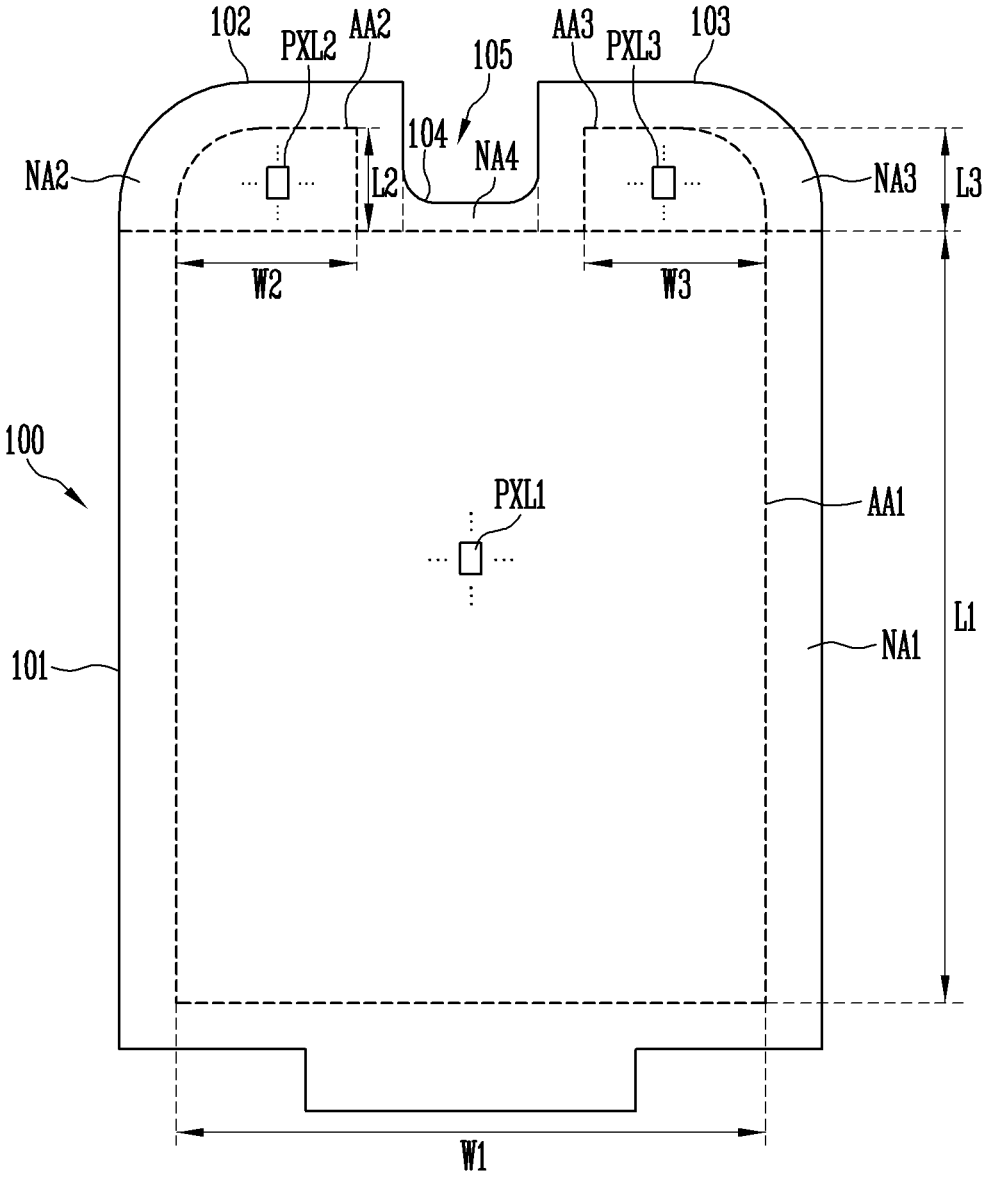
FIG. 1 is a view illustrating pixel regions of a display device according to an embodiment of the present disclosure.

Aspects and features of the present invention, and ways of attaining them, will become apparent with reference to some embodiments described below in conjunction with the accompanying drawings. However, the present disclosure is not limited to the embodiments described herein, but may be implemented in different forms. These embodiments are provided for illustrative purposes and for understanding of the scope of the present disclosure by those skilled in the art. In the specification, when an element is referred to as being "connected" or "coupled" to another element, it may be directly connected or coupled to the another element or may be indirectly connected or coupled to the another element with one or more intervening elements interposed therebetween. It is noted that in giving reference numerals to elements of each drawing, like reference numerals refer to like elements even though like elements are shown in different drawings.

Herein, a display device will be described with reference to some exemplary embodiments in conjunction with the accompanying drawings.

FIG. 1 is a view illustrating pixel regions of a display device according to an embodiment of the present disclosure.

Referring to FIG. 1, the display device according to an embodiment of the present disclosure may include pixel regions AA1, AA2, and AA3, peripheral regions NA1, NA2, NA3, and NA4, and pixels PXL1, PXL2, and PXL3.

A plurality of pixels PXL1, PXL2, and PXL3 are located in the pixel regions AA1, AA2, and AA3, and, accordingly, an image (e.g., a predetermined image) can be displayed in the pixel regions AA1, AA2, and AA3. Therefore, the pixel regions AA1, AA2, and AA3 may be referred to as a display region.

Components (e.g., drivers, lines, and the like) for driving the pixels PXL1, PXL2, and PXL3 may be located in the peripheral regions NA1, NA2, NA3, and NA4. The pixels PXL1, PXL2, and PXL3 do not exist in the peripheral regions NA1, NA2, NA3, and NA4, and therefore, the peripheral regions NA1, NA2, NA3, and NA4 may be referred to as a non-display region.

For example, the peripheral regions NA1, NA2, NA3, and NA4 may exist at the outside of the pixel regions AA1, AA2, and AA3, and may have a shape surrounding at least a portion of the pixel regions AA1, AA2, and AA3.

The pixel regions AA1, AA2, and AA3 may include a first pixel region AA1, a second pixel region AA2, and a third pixel region AA3.

The second pixel region AA2 and the third pixel region AA3 may be located at a side of the first pixel region AA1.

In an embodiment, the second pixel region AA2 and the third pixel region AA3 may be located to be spaced apart from each other.

The first pixel region AA1 may have a largest area as compared with the second pixel region AA2 and the third pixel region AA3.

For example, a width W1 of the first pixel region AA1 may be larger than widths W2 and W3 of the other pixels regions AA2 and AA3, and a length L1 of the first pixel region AA1 may be larger than widths L2 and L3 of the other pixels regions AA2 and AA3.

In addition, each of the second pixel region AA2 and the third pixel region AA3 may have an area smaller than that of the first pixel region AA1. The second pixel region AA2 and the third pixel region AA3 may have a same area or areas different from each other.

For example, the width W2 of the second pixel region AA2 may be equal to or different from the width W3 of the third pixel region AA3, and the length L2 of the second pixel region AA2 may be equal to or different from the width L3 of the third pixel region AA3.

The peripheral regions NA1, NA2, NA3, and NA4 may include a first peripheral region NA1, a second peripheral region NA2, a third peripheral region NA3, and a fourth peripheral region NA4.

The first peripheral region NA1 may exist at the periphery of the first pixel region AA1, and may have a shape surrounding at least a portion of the first pixel area AA1.

In an embodiment, the width of the first peripheral region NA1 may be set to be uniform. However, the present disclosure is not limited thereto, and the width of the first peripheral region NA1 may be differently set according to a position of the first peripheral region NA1.

The second peripheral region NA2 may exist at the periphery of the second pixel region AA2, and may have a shape surrounding at least a portion of the second pixel region AA2.

The width of the second peripheral region NA2 may be set to be uniform. However, the present disclosure is not limited thereto, and the width of the second peripheral region NA2 may be differently set according to a position of the second peripheral region NA2.

The third peripheral region NA3 may exist at the periphery of the third pixel region AA3, and may have a shape surrounding at least a portion of the third pixel region AA3.

The width of the third peripheral region NA3 may be set to be uniform. However, the present disclosure is not limited thereto, and the width of the third peripheral region NA3 may be differently set according to a position of the third peripheral region NA3.

The fourth peripheral region NA4 may exist at an outside of the first pixel region AA1. Also, the fourth peripheral region NA4 may be located between the second peripheral region NA2 and the third peripheral region NA3, to connect the second peripheral region NA2 and the third peripheral region NA3 to each other.

The width of the peripheral regions NA1, NA2, NA3, and NA4 may be set to be uniform. However, the present disclosure is not limited thereto, and the width of the peripheral regions NA1, NA2, NA3, and NA4 may be differently set according to positions of the peripheral regions NA1, NA2, NA3, and NA4.

The pixels PXL1, PXL2, and PXL3 may include first pixels PXL1, second pixels PXL2, and third pixels PXL3.

For example, the first pixels PXL1 may be located in the first pixel region AA1, the second pixels PXL2 may be located in the second pixel region AA2, and the third pixels PXL3 may be located in the third pixel region AA3.

The pixels PXL1, PXL2, and PXL3 may emit light with a luminance (e.g., a predetermined luminance) under the control of drivers located in the peripheral region NA1, NA2, and NA3. To this end, each of the pixels PXL1, PXL2, and PXL3 may include a light emitting device (e.g., an organic light emitting diode).

The pixel regions AA1, AA2, and AA3 and the peripheral regions NA1, NA2, NA3, and NA4 may be defined on a substrate 100 of the display device.

The substrate 100 may be made of an insulative material, such as glass or resin. Also, the substrate 100 may be made of a material having flexibility to be bendable or foldable, and may have a single- or multi-layered structure.

For example, the substrate 100 may include at least one of polystyrene, polyvinyl alcohol, polymethyl methacrylate, polyethersulfone, polyacrylate, polyetherimide, polyethylene naphthalate, polyethylene terephthalate, polyphenylene sulfide, polyarylate, polyimide, polycarbonate, triacetate cellulose, and cellulose acetate propionate.

However, the material constituting the substrate 100 may be varied. In an embodiment, the substrate 100 may be made of a fiber reinforced plastic (FRP), etc.

The substrate 100 may be formed in various shapes in which the pixel regions AA1, AA2, and AA3 and the peripheral regions NA1, NA2, NA3, and NA4 can be set.

For example, the substrate 100 may include a plate-shaped base substrate 101, and a first auxiliary plate 102, a second auxiliary plate 103, and a third auxiliary plate 104, which extend to protrude from an end portion of the base substrate 101.

In an embodiment, the first auxiliary plate 102, the second auxiliary plate 103, and the third auxiliary plate 104 may be integrally formed with the base substrate 101, and a concave part 105 may exist between the first auxiliary plate 102 and the second auxiliary plate 103.

The concave part 105 is a region in which a portion of the substrate 100 is removed. Therefore, the first auxiliary plate 102 and the second auxiliary plate 103 may be located to be spaced apart from each other.

Each of the first auxiliary plate 102 and the second auxiliary plate 103 may have an area smaller than that of the base substrate 101. The first auxiliary plate 102 and the second auxiliary plate 103 may have areas equal to or different from each other.

The third auxiliary plate 104 may have an area smaller than those of the first auxiliary plate 102 and the second auxiliary plate 103.

The first auxiliary plate 102 and the second auxiliary plate 103 may be formed in various shapes in which the pixel regions AA2 and AA3 and the peripheral regions NA2 and NA3 can be set.

The first pixel region AA1 and the first peripheral region NA1 may be defined on the base substrate 101, the second pixel region AA2 and the second peripheral region NA2 may be defined on the first auxiliary plate 102, and the third pixel region AA3 and the third peripheral region NA3 may be defined on the second auxiliary plate 103. The fourth peripheral region NA4 may be defined on the third auxiliary plate 104.

The base substrate 101 may have any of various shapes. For example, the base substrate 101 may have a shape such as a polygonal shape and a circular shape. In addition, at least a portion of the base substrate 101 may have a curved shape.

For example, the base substrate 101 may have a quadrangular shape as shown in FIG. 1.

Alternatively, corner parts of the base substrate 101 may be deformed in an inclined shape or a curved shape.

The base substrate 101 may have a shape equal or similar to that of the first pixel region AA1. However, the present disclosure is not limited thereto, and the base substrate 101 may have a shape different from that of the first pixel region AA1.

The first auxiliary plate 102 and the second auxiliary plate 103 may also have any of various shapes.

For example, the first auxiliary plate 102 and the second auxiliary plate 103 may have a shape such as a polygonal shape and a circular shape. In addition, at least portions of the first auxiliary plate 102 and the second auxiliary plate 103 may have a curved shape.

The concave part 105 may have any of various shapes. The concave part 105 may have a shape such as a polygonal shape and a circular shape. In addition, at least a portion of the concave part 105 may have a curved shape.

The first to third pixel regions AA1 to AA3 may have any of various shapes. For example, each of the first to third pixel regions AA1 to AA3 may have a shape such as a polygonal shape and a circular shape.

In FIG. 1, a case in which the first pixel region AA1 has a quadrangular shape is illustrated as an example. However, the present disclosure is not limited thereto. For example, at least a portion of the first pixel region AA1 may have a curved shape. For example, corner parts of the first pixel region AA1 may have a curved shape having a curvature (e.g., a predetermined curvature).

Also, in FIG. 1, a case in which at least portions of the second pixel region AA2 and the third pixel region AA3 have a curved shape is illustrated as an example. However, the present disclosure is not limited thereto, and the second pixel region AA2 and the third pixel region AA3 may have a quadrangular shape.

In this case, at least a portion of the second peripheral region NA2 may have a curved shape to correspond to the second pixel region AA2.

Corresponding to a change in shape of the second pixel region AA2, the number of second pixels PXL2 located on one line (e.g., one row or column) may be varied depending on a position in the second pixel region AA2.

In addition, at least a portion of the third peripheral region NA3 may have a curved shape to correspond to the third pixel region AA3.

Corresponding to a change in shape of the third pixel region AA3, the number of third pixels PXL3 located on one line (e.g., one row or column) may be varied depending on a position in the third pixel region AA3.

In an embodiment, the fourth peripheral region NA4 may have a shape corresponding to the concave part 105.

Figure 2:
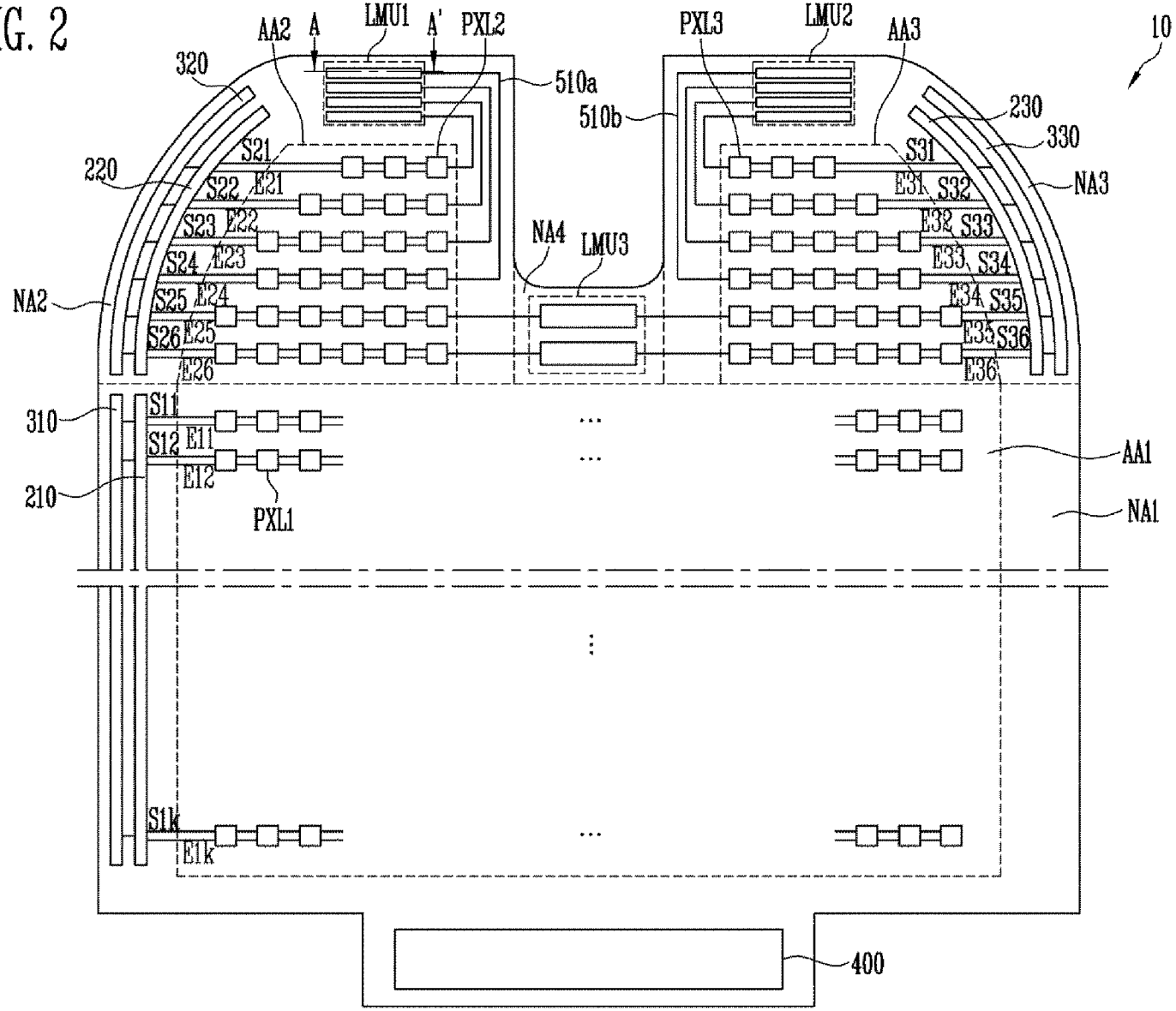
FIG. 2 is a view illustrating the display device according to an embodiment of the present disclosure.

FIG. 2 is a view illustrating the display device according to an embodiment of the present disclosure.

Referring to FIG. 2, the display device according to an embodiment of the present disclosure may include the substrate 100, the first pixels PXL1, the second pixels PXL2, the third pixels PXL3, a first scan driver 210, a second scan driver 220, a third scan driver 230, a first emission driver 310, a second emission driver 320, and a third emission driver 330.

The first pixels PXL1 are located in the first pixel region AA1, and may be connected to first scan lines S11 to S1*k*, first emission control lines E11 to E1*k*, and first data lines.

The first scan driver 210 may supply a first scan signal to the first pixels PXL1 through the first scan lines S11 to S1*k*.

For example, the first scan driver 210 may sequentially supply the first scan signal to the first scan lines S11 to S1*k*.

The first scan driver 210 may be located in the first peripheral region NA1. For example, the first scan driver 210 may be located in the first peripheral region NA1 that exists at one side (e.g., the left side based on FIG. 2) of the first pixel region AA1.

The first scan driver 210 may be electrically connected to the first scan lines S11 to S1*k*.

The first emission driver 310 may supply a first emission control signal to the first pixels PXL1 through the first emission control lines E11 to E1*k*. For example, the first emission driver 310 may sequentially supply the first emission control signal to the first emission control lines E11 to E1*k*.

The first emission driver 310 may be located in the first peripheral region NA1. For example, the first emission driver 310 may be located in the first peripheral region NA1 that exists at one side (e.g., the left side based on FIG. 2) of the first pixel region AA1.

In FIG. 2, it is illustrated that the first emission driver 310 is located at the outside of the first scan driver 210. On the contrary, the first emission driver 310 may be located at the inside of the first driver 210.

The first emission driver 310 may be electrically connected to the first emission control lines E11 to E1*k*.

Meanwhile, when first pixels PXL1 have a structure in which it is unnecessary for the first pixels PXL1 to use the first emission control signal, the first emission driver 310 and the first emission control lines E11 to E1*k* may be omitted.

In FIG. 1, it is illustrated that the first scan driver 210 and the first emission driver 310 are disposed at the left side of the first pixel region AA1, but the present disclosure is not limited thereto. For example, the first scan driver 210 and the first emission driver 310 may be disposed at the right side of the first pixel region AA1 or be disposed at the left and right sides of the first pixel region AA1.

The second pixels PXL2 are located in the second pixel region AA2, and may be connected to second scan lines S21 to S26, second emission control lines E21 to E26, and second data lines.

The second scan driver 220 may supply a second scan signal to the second pixels PXL2 through the second scan lines S21 to S26.

For example, the second scan driver 220 may sequentially supply the second scan signal to the second scan lines S21 to S26.

The second scan driver 220 may be located in the second peripheral region NA2. For example, the second scan driver 220 may be located in the second peripheral region NA2 that exists at one side (e.g., the left side based on FIG. 2) of the second pixel region AA2.

The second scan driver 220 may be electrically connected to the second scan lines S21 to S26.

The second emission driver 320 may supply a second emission control signal to the second pixels PXL2 through the second emission control lines E21 to E26. For example, the second emission driver 320 may sequentially supply the second emission control signal to the second emission control lines E21 to E26.

The second emission driver 320 may be located in the second peripheral region NA2. For example, the second emission driver 320 may be located in the second peripheral region NA2 that exists at one side (e.g., the left side based on FIG. 2) of the second pixel region AA2.

In FIG. 2, it is illustrated that the second emission driver 320 is located at the outside of the second scan driver 220. However, the second emission driver 320 may be located at the inside of the second scan driver 220.

The second emission driver 320 may be electrically connected to the second emission control lines E21 to E26.

In an embodiment, when the second pixels PXL2 have a structure in which it is unnecessary for the second pixels PXL2 to use the second emission control signal, the second emission driver 320 and the second emission control lines E21 to E26 may be omitted.

Also, in FIG. 2, it is illustrated that the second pixels PXL2 are arranged to form six horizontal lines, but the present disclosure is not limited thereto. For example, the number of horizontal lines of the pixels provided in the second pixel region AA2 may be variously changed, and, therefore, the number of second scan lines and second emission control lines may also be variously changed.

In an embodiment, the second pixel region AA2 has an area smaller than that of the first pixel region AA1, and the lengths of the second scan lines S21 to S26 and the second emission control lines E21 to E26 may be shorter than those of the first scan lines S11 to S1*k* and the first emission control lines E11 to E1*k*.

In addition, the number of second pixels PXL2 connected to one of the second scan lines S21 to S26 may be smaller than that of first pixels PXL1 connected to one of the first scan lines S11 to S1*k*, and the number of second pixels PXL2 connected to one of the second emission control lines E21 to E26 may be smaller than that of first pixels PXL1 connected to one of the first emission control lines E11 to E1*k*.

The third pixels PXL3 are located in the third pixel region AA3, and may be connected to third scan lines S31 to S36, third emission control lines E31 to E36, and third data lines.

The third scan driver 230 may supply a third scan signal to the third pixels PXL3 through the third scan lines S31 to S36. For example, the third scan driver 230 may sequentially supply the third scan signal to the third scan lines S31 to S36.

The third scan driver 230 may be located in the third peripheral region NA3. For example, the third scan driver 230 may be located in the third peripheral region NA3 that exists at one side (e.g., the right side based on FIG. 2) of the third pixel region AA3.

The third scan driver 230 may be electrically connected to the third scan lines S31 to S36.

The third emission driver 330 may supply a third emission control signal to the third pixels PXL3 through the third emission control lines E31 to E36. For example, the third emission driver 330 may sequentially supply the third emission control signal to the third emission control lines E31 to E36.

The third emission driver 330 may be located in the third peripheral region NA3. For example, the third emission driver 330 may be located at one side (e.g., the right side based on FIG. 2) of the third pixel region AA3.

In FIG. 2, it is illustrated that the third emission driver 330 is located at the outside of the third scan driver 230. However, the third emission driver 330 may be located at the inside of the third scan driver 230.

The third emission driver 330 may be electrically connected to the third emission control lines E31 to E36.

In an embodiment, when the third pixels PXL3 have a structure in which it is unnecessary for the third pixels PXL3 to use the third emission control signal, the third emission driver 330 and the third emission control lines E31 to E36 may be omitted.

Also, in FIG. 2, it is illustrated that the third pixels PXL3 are arranged to form six horizontal lines, but the present disclosure is not limited thereto. For example, the number of horizontal lines of the pixels provided in the third pixel region AA3 may be variously changed, and therefore, the number of third scan lines and third emission control lines may also be variously changed.

Since the third pixel region AA3 has an area smaller than that of the first pixel region AA1, the lengths of the third scan lines S31 to S36 and the third emission control lines E31 to E36 may be shorter than those of the first scan lines S11 to S1*k* and the first emission control lines E11 to E1*k*.

In addition, the number of third pixels PXL3 connected to one of the third scan lines S31 to S36 may be smaller than that of first pixels PXL1 connected to one of the first scan lines S11 to S1*k*, and the number of third pixels PXL3 connected to one of the third emission control lines E31 to E36 may be smaller than that of first pixels PXL1 connected to one of the first emission control lines E11 to E1*k*.

The emission control signal is used to control emission times of the pixels PXL1, PXL2, and PXL3. To this end, the emission control signal may be set to have a width wider than that of the scan signal.

For example, the emission control signal may be set to a gate-off voltage (e.g., a high-level voltage) such that transistors included in the pixels PXL1, PXL2, and PXL3 can be turned off, and the scan signal may be set to a gate-on voltage (e.g., a low-level voltage) such that the transistors included in the pixels PXL1, PXL2, and PXL3 can be turned on.

A data driver 400 may supply a data signal to the pixels PXL1, PXL2, and PXL3 through the data lines.

The data driver 400 may be located in the first peripheral region NA1. In particular, the data driver 400 may exist at a position at which it does not overlap with the first scan driver 210. For example, the data driver 400 may be located in the first peripheral region NA1 that exists at a lower side of the first pixel region AA1.

The data driver 400 may be installed in any of various ways, including chip on glass, chip on plastic, tape carrier package, chip on film, and the like.

For example, the data driver may be directly mounted on the substrate 100, or may be connected to the substrate 100 through a separate component (e.g., a flexible printed circuit board).

In an embodiment, although not shown in FIG. 2, the display device 10 may further include a timing controller that provides a control signal (e.g., a predetermined control signal) to the scan drivers 210, 220, and 230, the emission drivers 310, 320, and 330, and the data driver 400.

The display device 10 according to an embodiment of the present disclosure may further include load matching units LMU1, LMU2, and LMU3. The load matching units LMU1, LMU2, and LMU3 may include first load matching units LMU1, second load matching units LMU2, and third load matching unit LMU3.

The first load matching units LMU1 may be electrically connected to the second scan lines S21 to S24, and may also be electrically connected to the second pixels PXL2 through the second scan lines S21 to S24.

The first load matching units LMU1 may be provided in the second peripheral region NA2, and may be provided at an upper side of the second pixel region AA2 based on FIG. 2.

The second load matching units LMU2 may be electrically connected to the third scan lines S31 to S34, and may also be electrically connected to the third pixels PXL3 through the third scan lines S31 to S34.

The second load matching units LMU2 may be provided in the third peripheral region NA3, and may be provided at an upper side of the third pixel region AA3 based on FIG. 2.

The third load matching units LMU3 may be electrically connected to the other second scan lines S25 and S26 and the other third scan lines S35 and S36. The third load matching units LMU3 may be electrically connected to the second pixels PXL2 through the second scan lines S25 and S26, and be electrically connected to the third pixels PXL3 through the third scan lines S35 and S36.

The load matching units LMU1, LMU2, and LMU3 may function to allow load values of the second scan lines S21 to S26 and the third scan lines S31 to S36 to be equal or similar to that of the first scan lines S11 to S1*k*.

Since the first scan lines S11 to S1*k* have a length longer than that of the second scan lines S21 to S26, the load value of the first scan lines S11 to S1*k* is larger than that of the second scan lines S21 to S26. Since the time for which a signal is delayed becomes longer as the load value becomes larger, the time for which the first scan signal is delayed becomes larger than that for which the second scan signal is delayed. In this case, the data signal charge rate of the second pixels PXL2 is different from that of the first pixels PXL1, and, therefore, there occurs a difference in luminance between an image displayed in the first pixel region AA1 and an image displayed in the second pixel region AA2. In addition, there occurs a difference in luminance between an image displayed in the first pixel region AA1 and an image displayed in the third pixel region AA3.

However, the display device 10 according to an embodiment of the present disclosure includes the load matching units LMU1, LMU2, and LMU3 that allow the load values of the second scan lines S21 to S26 and the third scan lines S31 to S36 to be increased, thereby avoiding the above-described problems.

The display device 10 according to an embodiment of the present disclosure may include a protection unit located between the load matching units LMU1, LMU2, and LMU3. The protection unit may function to protect the pixels PXL2 and PXL3 from static electricity introduced into the load matching units LMU1, LMU2, and LMU3.

In FIG. 2, it is illustrated that the protection unit includes a protection line. However, in some embodiments, the protection unit may include an electrostatic discharge protection circuit.

Figure 3:
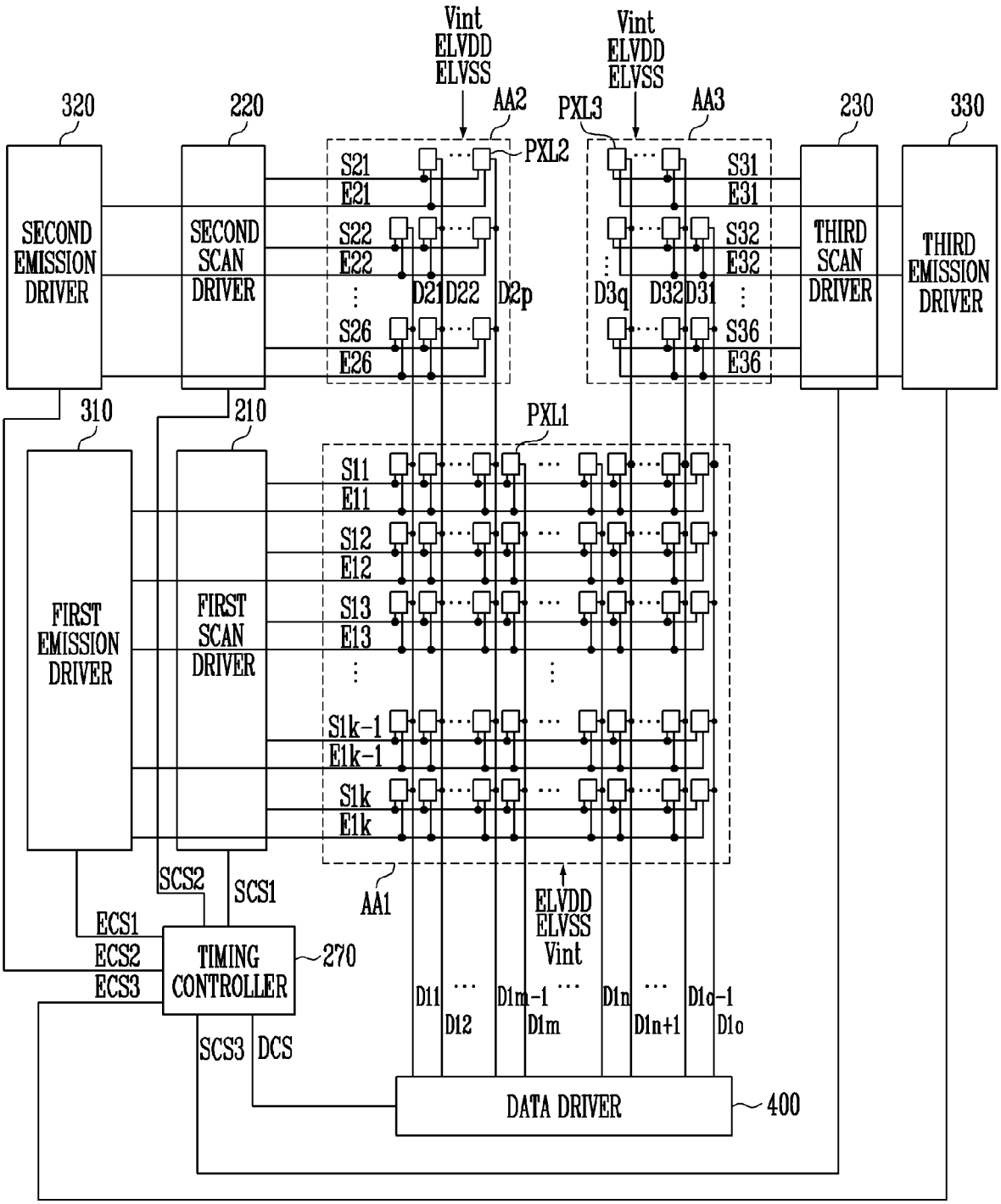
FIG. 3 is a view illustrating a configuration of the display device according to an embodiment of the present disclosure.

FIG. 3 is a view illustrating a configuration of the display device according to an embodiment of the present disclosure.

The first scan driver 210 may supply the first scan signal to the first pixels PXL1 through the first scan lines S11 to S1*k*.

The first emission driver 310 may supply the first emission control signal to the first pixels PXL1 through the first emission control lines E11 to E1*k*.

The first scan driver 210 and the first emission driver 310 may operate corresponding to a first scan driver control signal SCS1 and a first emission driver control signal ECS1, respectively.

The data driver 400 may supply a data signal to the first pixels PXL1 through first data lines D11 to D1*o*.

The first pixels PXL1 may be connected to a first power source ELVDD and a second power source ELVDD. In an embodiment, the first pixels PXL1 may be additionally connected to an initialization power source Vint.

The first pixels PXL1 may be supplied with the data signal from the first data lines D11 to D1*o* when the first scan signal is supplied to the first scan lines S11 to S1*k*. Each of the first pixels PXL1 supplied with the data signal may control an amount of current flowing from the first power source ELVDD to the second power source ELVDD via an organic light emitting diode (not shown).

The second scan driver 220 may supply the second scan signal to the second pixels PXL2 through the second scan lines S21 to S26.

The second emission driver 320 may supply the second emission control signal to the second pixels PXL2 through the second emission control lines E21 to E26.

The second scan driver 220 and the second emission driver 320 may operate corresponding to a second scan driver control signal SCS2 and a second emission driver control signal ECS2, respectively.

The data driver 400 may supply a data signal to the second pixels PXL2 through second data lines D21 to D2*p*.

For example, the second data lines D21 to D2*p* may be connected to some first data lines D11 to D1*m*−1.

In addition, the second pixels PXL2 may be connected to the first power source ELVDD and the second power source ELVSS. In an embodiment, the second pixels PXL2 may be additionally connected to the initialization power source Vint.

The second pixels PXL2 may be supplied with the data signal from the second data lines D21 to D2*p* when the second scan signal is supplied to the second scan lines S21 to S26. Each of the second pixels PXL2 supplied with the data signal may control an amount of current flowing from the first power source ELVDD to the second power source ELVSS via an organic light emitting diode (not shown).

In addition, the number of second pixels PXL2 located on one line (e.g., one row or column) may be varied depending on a position in the second pixel region AA2.

In an embodiment, the second pixel region AA2 has an area smaller than that of the first pixel region AA1, and the number of the second pixels PXL2 may be smaller than that of the first pixels PXL1, and the lengths and number of the second scan lines S21 to S26 and the second emission control lines E21 to E26 may be set smaller than those of the first scan lines S11 to S1*k* and the first emission control lines E11 to E1*k*.

The number of second pixels PXL2 connected to any one of the second scan lines S21 to S26 may be smaller than that of first pixels PXL1 connected to any one of the first scan lines S11 to S1*k*.

In addition, the number of second pixels PXL2 connected to any one of the second emission control lines E21 to E26 may be smaller than that of first pixels PXL1 connected to any one of the first emission control lines E11 to E1*k*.

The third scan driver 230 may supply the third scan signal to the third pixels PXL3 through the third scan lines S31 to S36.

The third scan driver 230 may operate corresponding to a third scan driver control signal SCS3.

The third emission driver 330 may supply the third emission control signal to the third pixels PXL3 through the third emission control lines E31 to E36.

The third emission driver 330 may operate corresponding to a third emission driver control signal ECS3.

The data driver 400 may supply a data signal to the third pixels PXL3 through third data lines D31 to D3*q*.

The third data lines D31 to D3*q* may be connected to some first data lines D1*n*+1 to D1*o*.

The third pixels PXL3 may be connected to the first power source ELVDD and the second power source ELVSS. In an embodiment, the third pixels PXL3 may be additionally connected to the initialization power source Vint.

The third pixels PXL3 may be supplied with the data signal from the third data lines D31 to D3*q* when the third scan signal is supplied to the third scan lines S31 to S36. Each of the third pixels PXL3 may control an amount of current flowing from the first power source ELVDD to the second power source ELVDD via an organic light emitting diode (not shown).

In addition, the number of third pixels PXL3 located on one line (e.g., one row or column) may be varied depending on a position in the third pixel region AA3.

In an embodiment, the third pixel region AA3 has an area smaller than that of the first pixel region AA1, the number of the third pixels PXL3 may be smaller than that of the first pixels PXL1, and the lengths of the third scan lines S31 to S36 and the third emission control lines E31 to E36 may be shorter than those of the first scan lines S11 to S1*k* and the first emission control lines E11 to E1*k*.

The number of third pixels PXL3 connected to any one of the third scan lines S31 to S36 may be smaller than that of the first pixels PXL1 connected to any one of the first scan lines S11 to S1*k*.

In addition, the number of third pixels PXL3 connected to any one of the third emission control lines E31 to E36 may be smaller than that of first pixels PXL1 connected to any one of the first emission control lines E11 to E1*k*.

The data driver 400 may operate corresponding to a data driver control signal DCS.

A timing controller 270 may control the first scan driver 210, the second scan driver 220, the third scan driver 230, the data driver 400, the first emission driver 310, the second emission driver 320, and the third emission driver 330.

To this end, the timing controller 270 may supply the first scan driver control signal SCS1, the second scan driver control signal SCS2, and the third scan driver control signal SCS3, respectively, to the first scan driver 210, the second scan driver 220, and the third scan driver 230, and may supply the first emission driver control signal ECS1, the second emission driver control signal ECS2, and the third emission driver control signal ECS3, respectively, to the first emission driver 310, the second emission driver 320, and the third emission driver 330.

In an embodiment, each of the scan driver control signals SCS1, SCS2, and SCS3 and the emission driver control signals ECS1, ECS2, and ECS3 may include at least one clock signal and a start pulse.

The start pulse may control timings of the first scan signal and the first emission control signal. The clock signal may be used to shift the start pulse.

In addition, the timing controller 270 may supply the data driver control signal DCS to the data driver 400.

The data driver control signal DCS may include a source start pulse and at least one clock signal. The source start pulse may control a sampling start time of data, and the clock signal may be used to control a sampling operation.

Figure 4:
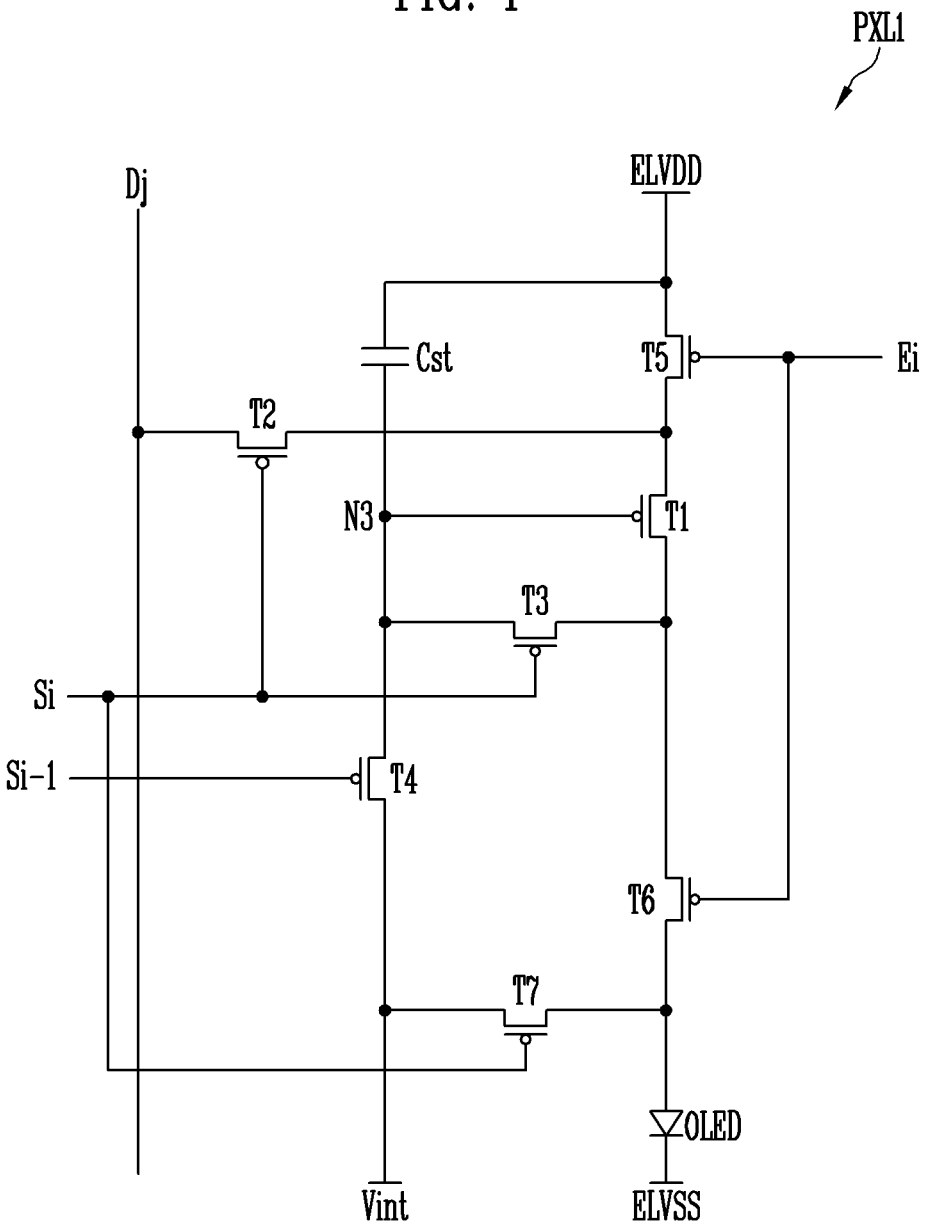
FIG. 4 is a schematic view illustrating an embodiment of a first pixel shown in FIGS. 1 to 3.

FIG. 4 is a view illustrating an embodiment of the first pixel shown in FIGS. 1 to 3.

For convenience of description, a pixel PXL1 connected to a jth data line Dj and an ith scan line Si is illustrated in FIG. 4.

Referring to FIG. 4, the pixel PXL1 according to an embodiment of the present disclosure may include an organic light emitting device OLED, first to seventh transistors T1 to T7, and a storage capacitor Cst.

An anode of the organic light emitting device OLED may be connected to the first transistor T1 via the sixth transistor T6, and a cathode of the organic light emitting device OLED may be connected to a second power source ELVSS. The organic light emitting device OLED may generate light with a luminance (e.g., a predetermined luminance) corresponding to an amount of current supplied from the first transistor T1.

A first power source ELVDD may be set to a voltage higher than that of the second power source ELVSS such that current can flow in the organic light emitting device OLED.

The seventh transistor T7 may be connected between the initialization power source Vint and the anode of the organic light emitting device OLED. In addition, a gate electrode of the seventh transistor T7 may be connected to the ith scan line Si. The seventh transistor T7 may be turned on when a scan signal is supplied to the ith scan line Si, to supply the voltage of the initialization power source Vint to the anode of the organic light emitting device OLED. Here, the initialization power source Vint may be set to a voltage lower than a data signal.

The sixth transistor T6 may be connected between the first transistor T1 and the organic light emitting device OLED. In addition, a gate electrode of the sixth transistor T6 may be connected to an ith emission control line Ei. The sixth transistor T6 may be turned off when an emission control signal is supplied to the ith emission control line Ei, and may be turned on otherwise.

The fifth transistor T5 may be connected between the first power source ELVDD and the first transistor T1. In addition, a gate electrode of the fifth transistor T5 may be connected to the ith emission control line Ei. The fifth transistor T5 may be turned off when the emission control signal is supplied to the ith emission control line Ei, and may be turned on otherwise.

A first electrode of the first transistor (drive transistor) T1 may be connected to the first power source ELVDD via the fifth transistor T5, and a second electrode of the first transistor T1 may be connected to the anode of the organic light emitting device OLED via the sixth transistor T6. In addition, a gate electrode of the first transistor T1 may be connected to a third node N3. The first transistor T1 may control an amount of current flowing from the first power source ELVDD to the second power source ELVSS via the organic light emitting device OLED, corresponding to a voltage of the third node N3.

The third transistor T3 may be connected between the second electrode of the first transistor T1 and the third node N3. In addition, a gate electrode of the third transistor T3 may be connected to the ith scan line Si. The third transistor T3 may be turned on when a scan signal is supplied to the ith scan line Si, to allow the second electrode of the first transistor T1 to be electrically connected to the third node N3. Therefore, when the third transistor T3 is turned on, the first transistor T1 may be diode-connected.

The fourth transistor T4 may be connected between the third node N3 and the initialization power source Vint. In addition, a gate electrode of the fourth transistor T4 may be connected to an (i−1)th scan line Si−1. The fourth transistor T4 may be turned on when a scan signal is supplied to the (i−1)th scan line Si−1, to supply the voltage of the initialization power source Vint to the third node N3.

The second transistor T2 may be connected between the jth data line Dj and the first electrode of the first transistor T1. In addition, a gate electrode of the second transistor T2 may be connected to the ith scan line Si. The second transistor T2 may be turned on when a scan signal is supplied to the ith scan line Si, to allow the jth data line Dj to be electrically connected to the first electrode of the first transistor T1.

The storage capacitor Cst may be connected between the first power source ELVDD and the third node N3. The storage capacitor Cst may store a voltage corresponding to the data signal and the threshold voltage of the first transistor T1.

Figure 5:
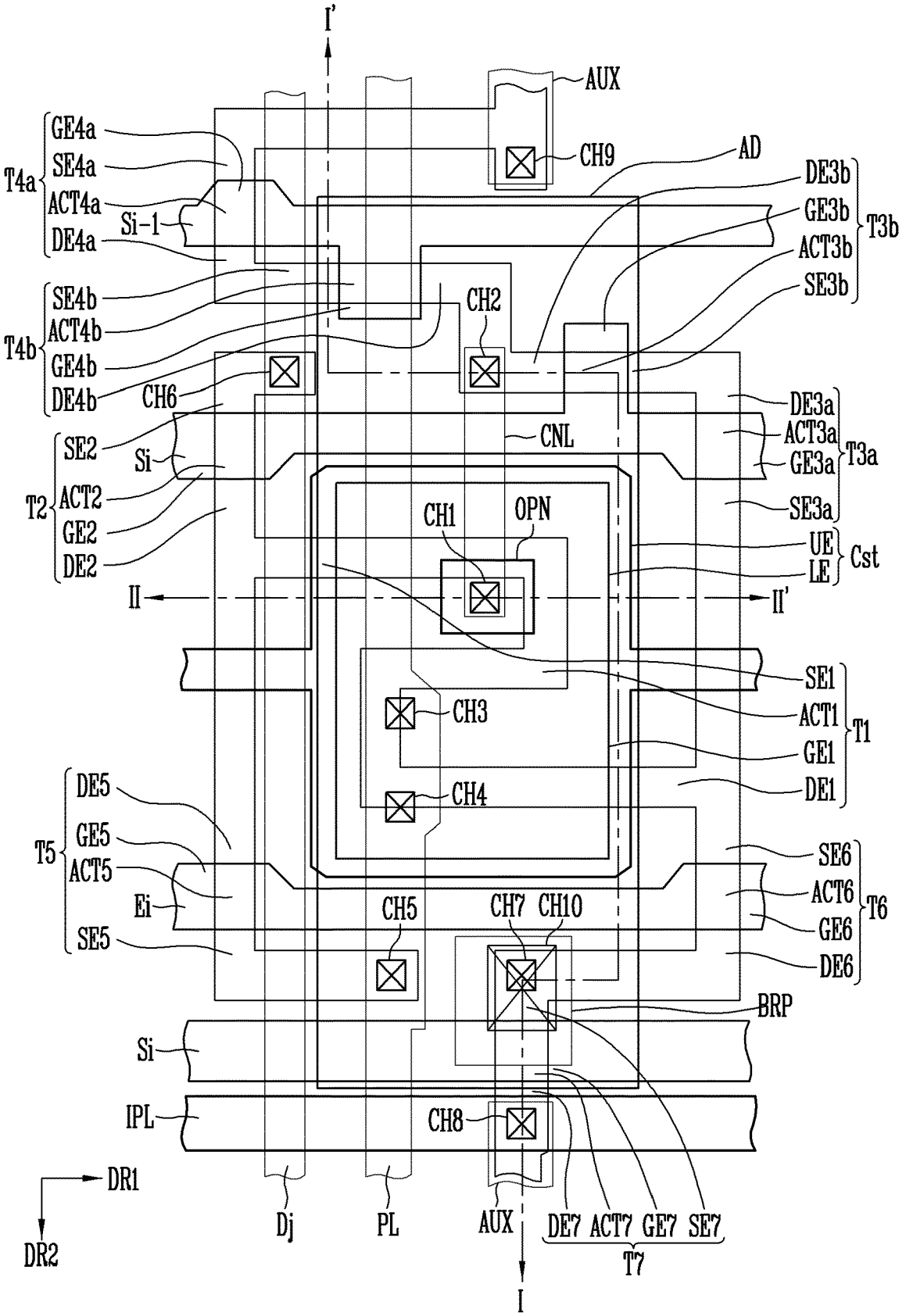
FIG. 5 is a plan view illustrating a first pixel shown in FIG. 2.
Figure 6:
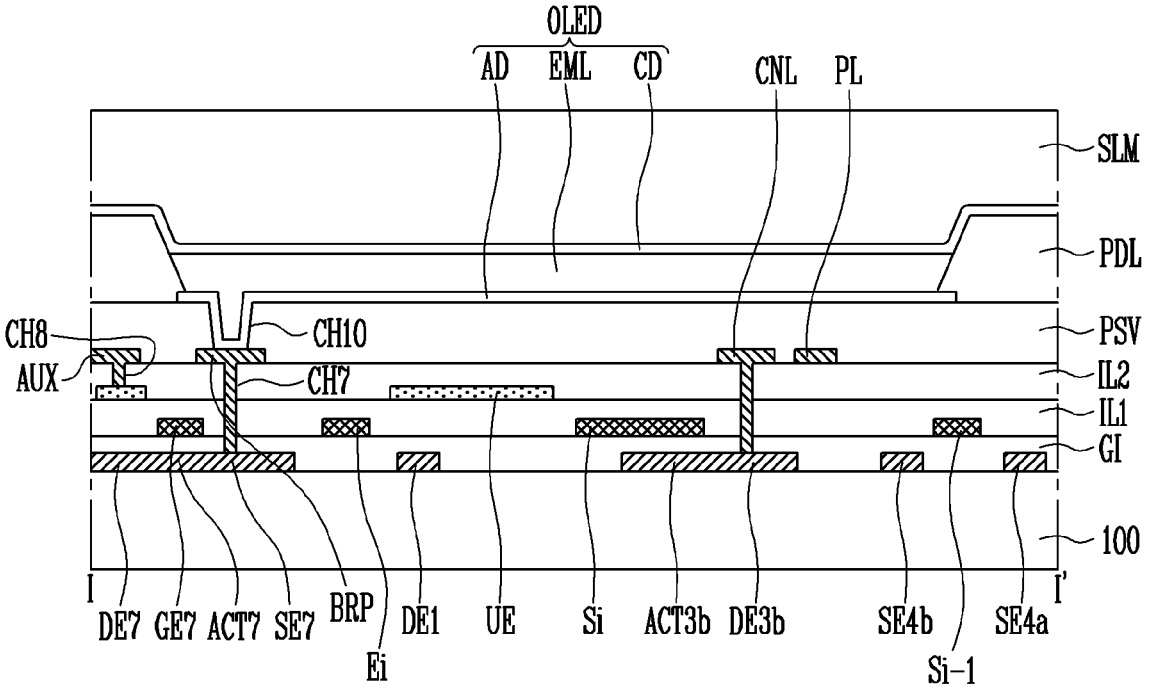
FIG. 6 is a cross-sectional view taken along the line I-I' of FIG. 5.

FIG. 5 is a plan view illustrating the first pixel shown in FIG. 2; FIG. 6 is a cross-sectional view taken along the line I-I' of FIG. 5; and FIG. 7 is a cross-sectional view taken along the line II-II' of FIG. 5.

Figure 7:
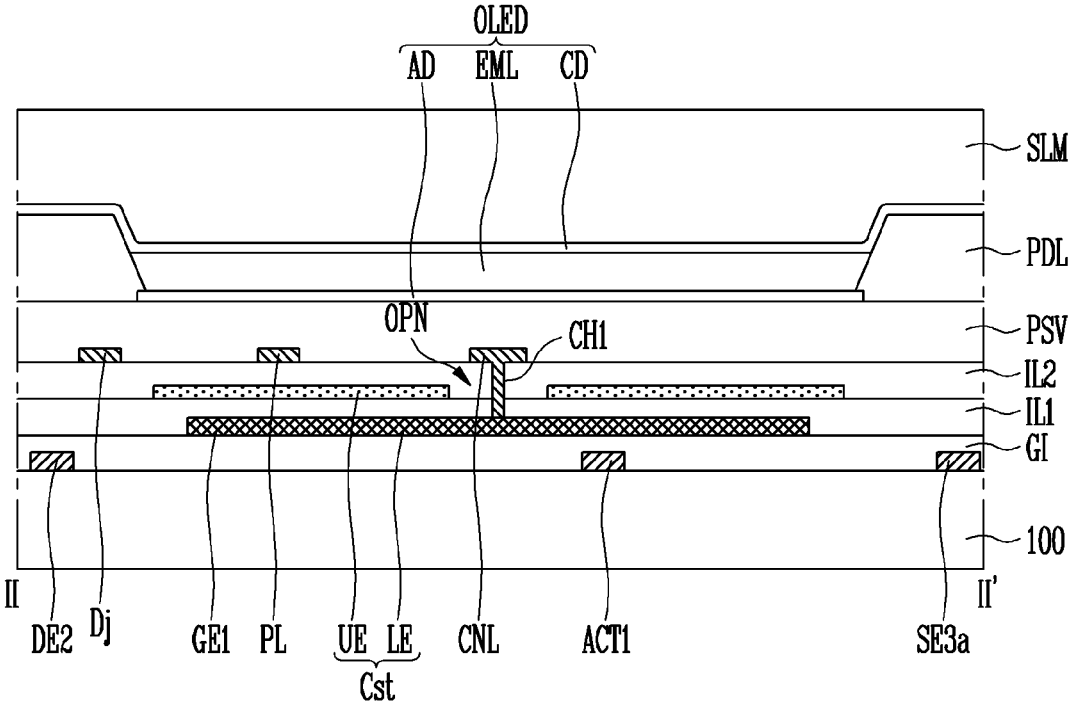
FIG. 7 is a cross-sectional view taken along the line II-II' of FIG. 5.

Based on one pixel PXL1 disposed on an ith row and a jth column, two scan lines Si−1 and Si, an emission control line Ei, a power line PL, and a data line Dj, which are connected to the pixel PXL1, are illustrated in FIGS. 5 to 7.

In FIGS. 5 to 7, for convenience of description, a scan line on an (i−1)th row is referred to as an "(i−1)th scan line Si−1," a scan line on the ith row is referred to as an "ith scan line Si," an emission control line on the ith row is referred to as an "emission control line Ei," a data line on the jth column is referred to as a "data line Dj," and a power line on the jth column is referred to as a "power line PL."

A line unit provides signals to each of the pixels PXL1, and may include scan lines Si−1 and Si, a data line Dj, an emission control line Ei, a power line PL, and an initialization power line IPL.

The scan lines Si−1 and Si may extend in a first direction DR1. The first scan lines Si−1 and Si may include an (i−1)th scan line Si−1 and an ith scan line Si, which are sequentially arranged along a second direction DR2.

The scan lines Si−1 and Si may be applied with a scan signal. For example, the (i−1)th scan line Si−1 may be applied with an (i−1)th scan signal, and the ith scan line Si may be applied with an ith scan signal.

The ith scan line Si may branch off into two lines, and the branching-off ith scan lines Si may be connected to different transistors. For example, the ith scan line Si may include an upper ith scan line Si adjacent to the (i−1)th scan line Si−1 and a lower ith scan line Si more distant from the (i−1)th scan line Si−1 than the upper ith scan line Si.

The emission control line Ei may extend in the first direction DR1. The emission control line Ei is disposed between the two ith scan lines Si to be spaced apart from the ith scan lines Si. The emission control line Ei may be applied with an emission control signal.

The data line Dj may extend in the second direction DR2. The data line Dj may be applied with a data signal.

The power line PL may extend in the second direction DR2. The power line PL may be disposed to be spaced apart from the data line Dj. The power line PL may be applied with the first power source ELVDD.

The initialization power line IPL may extend along the first direction DR1. The initialization power line IPL may be provided between the lower ith scan line Si and an (i−1)th scan line Si−1 of a pixel on a next row. The initialization power line IPL may be applied with the initialization power source Vint.

Each of the pixels PXL may include first to seventh transistors T1 to T7, a storage capacitor Cst, and a light emitting device OLED.

The first transistor T1 may include a first gate electrode GE1, the first active pattern ACT1, a first source electrode SE1, a first drain electrode DE1, and a connection line CNL.

The first gate electrode GE1 may be connected to a third drain electrode DE3 of the third transistor T3 and a fourth drain electrode DE4 of the fourth transistor T4. The connection line CNL may connect between the first gate electrode GE1 and the third and fourth drain electrodes DE3 and DE4. One end of the connection line CNL may be connected to the first gate electrode GE1 through a first contact hole CH1, and the other end of the connection line CNL may be connected to the third and fourth drain electrodes DE3 and DE4 through a second contact hole CH2.

In an embodiment of the present disclosure, the first active pattern ACT1, the first source electrode SE1, and the first drain electrode DE1 may be formed of a semiconductor layer undoped or doped with an impurity. For example, the first source electrode SE1 and the first drain electrode DE1 may be formed of a semiconductor layer doped with the impurity, and the active pattern ACT1 may be formed of a semiconductor layer undoped with the impurity.

In an embodiment, the first active pattern ACT1 has a bar shape extending in a predetermined direction, and may have a shape in which it is bent plural times along the extending direction.

The first active pattern ACT1 may overlap with the first gate electrode GE1 when viewed on a plane. In an embodiment, as the first active pattern ACT1 is formed long, a channel region of the first transistor T1 can be formed long. Thus, the driving range of a gate voltage applied to the first transistor T1 can be widened. Accordingly, the gray scale of light emitted from the organic light emitting device OLED can be minutely controlled.

The first source electrode SE1 may be connected to one end of the first active pattern ACT1. The first source electrode SE1 may be connected to a second drain electrode DE2 of the second transistor T2 and a fifth drain electrode DE5 of the fifth transistor T5. The first drain electrode DE1 may be connected to the other end of the first active pattern ACT1. The first drain electrode DE1 may be connected to a third source electrode SE3 of the third transistor T3 and a sixth source electrode SE6 of the sixth transistor T6.

The second transistor T2 may include a second gate electrode GE2, a second active pattern ACT2, and a second source electrode SE2, and the second drain electrode DE2.

The second gate electrode GE2 may be connected to the upper ith scan line Si. The second gate electrode GE2 may be provided as a portion of the upper ith scan line Si or may be provided in a shape protruding from the upper ith scan line Si.

In an embodiment of the present disclosure, the second active pattern ACT2, the second source electrode SE2, and the second drain electrode DE2 may be formed of a semiconductor undoped or doped with an impurity.

For example, the second source electrode SE2 and the second drain electrode DE2 may be formed of a semiconductor doped with the impurity, and the second active pattern ACT2 may be formed of a semiconductor layer undoped with the impurity.

The second active pattern ACT2 corresponds to a portion overlapping with the second gate electrode GE2. One end of the second source electrode SE2 may be connected to the second active pattern ACT2. The other end of the second source electrode SE2 may be connected to the data line Dj through a sixth contact hole CH6. One end of the second drain electrode DE2 may be connected to the second active pattern ACT2. The other end of the second drain electrode DE2 may be connected to the first source electrode SE1 of the first transistor T1 and the fifth drain electrode DE5 of the fifth transistor T5.

The third transistor T3 may be provided in a double gate structure so as to prevent a leakage current. That is, the third transistor T3 may include a 3*ath* transistor T3*a* and a 3*bth* transistor T3*b*. The 3*ath* transistor T3*a* may include a 3*ath* gate electrode GE3*a*, a 3*ath* active pattern ACT3*a*, a 3*ath* source electrode SE3*a*, and a 3*ath* drain electrode DE3*a*.

The 3*bth* transistor T3*b* may include a 3*bth* gate electrode GE3*b*, a 3*bth* active pattern ACT3*b*, a 3*bth* source electrode SE3*b*, and a 3*bth* drain electrode DE3*b*.

Herein, the 3*ath* gate electrode GE3*a* and the 3*bth* gate electrode GE3*b* are referred to as a third gate electrode GE3, the 3*ath* active pattern ACT3*a* and the 3*bth* active pattern ACT3*b* are referred to as a third active pattern ACT3, the 3*ath* source electrode SE3*a* and the 3*bth* source electrode SE3*b* are referred to as the third source electrode SE3, and the 3*ath* drain electrode DE3*a* and the 3*bth* drain electrode DE3*b* are referred to as the third drain electrode DE3.

The third gate electrode GE3 may be connected to the upper ith scan line Si. The third gate electrode GE3 may be provided as a portion of the upper ith scan line Si or may be provided in a shape protruding from the upper ith scan line Si.

For example, the 3*ath* gate electrode GE3*a* may be provided in a shape protruding from the upper ith scan line Si, and the 3*bth* gate electrode GE3*b* may be provided as a portion of the upper ith scan line Si.

The third active pattern ACT3, the third source electrode SE3, and the third drain electrode DE3 may be formed of a semiconductor layer undoped or doped with an impurity.

For example, the third source electrode SE3 and the third drain electrode DE3 may be formed of a semiconductor layer doped with the impurity, and the third active pattern ACT3 may be formed of a semiconductor layer undoped with the impurity. The third active pattern ACT3 corresponds to a portion overlapping with the third gate electrode GE3. One end of the third source electrode SE3 may be connected to the third active pattern ACT3. The other end of the third source electrode SE3 may be connected to the first drain electrode DE1 of the first transistor T1 and the sixth source electrode SE6 of the sixth transistor T6. One end of the third drain electrode DE3 may be connected to the third active pattern ACT3. The other end of the third drain electrode DE3 may be connected to the fourth drain electrode DE4 of the fourth transistor T4. Also, the third drain electrode DE3 may be connected to the first gate electrode GE1 of the first transistor T1 through the connection line CNL, the second contact hole CH2, and the first contact hole CH1.

In an embodiment, the fourth transistor T4 may be provided in a double gate structure so as to prevent a leakage current. That is, the fourth transistor T4 may include a 4*ath* transistor T4*a* and a 4*bth* transistor T4*b*. The 4*ath* transistor T4*a* may include a 4*ath* gate electrode GE4*a*, a 4*ath* active pattern ACT4*a*, a 4*ath* source electrode SE4*a*, and a 4*ath* drain electrode DE4*a*, and the 4*bth* transistor T4*b* may include a 4*bth* gate electrode GE4*b*, a 4*bth* active pattern ACT4*b*, a 4*bth* source electrode SE4*b*, and a 4*bth* drain electrode DE4*b*.

Herein, the 4*ath* gate electrode GE4*a* and the 4*bth* gate electrode GE4*b* are referred to as a fourth gate electrode GE4, the 4*ath* active pattern ACT4*a* and the 4*bth* active pattern ACT4*b* are referred to as a fourth active pattern ACT4, the 4*ath* source electrode SE4*a* and the 4*bth* source electrode SE4*b* are referred to as a fourth source electrode SE4, and the 4*ath* drain electrode DE4*a* and the 4*bth* drain electrode DE4*b* are referred to as the fourth drain electrode DE4.

The fourth gate electrode GE4 may be connected to the (i−1)th scan line Si−1. The fourth gate electrode GE4 may be provided as a portion of the (i−1)th scan line Si−1 or may be provided in a shape protruding from the (i−1)th scan line Si−1. For example, the 4*ath* gate electrode GE4*a* may be provided as a portion of the (i−1)th scan line Si−1. The 4*bth* gate electrode GE4*b* may be provided in a shape protruding from the (i−1)th scan line Si−1.

The fourth active pattern ACT4, the fourth source electrode SE4, and the fourth drain electrode DE4 may be formed of a semiconductor layer undoped or doped with an impurity. For example, the fourth source electrode SE4 and the fourth drain electrode DE4 may be formed of a semiconductor layer doped with the impurity, and the fourth active pattern ACT4 may be formed of a semiconductor layer undoped with the impurity. The fourth active pattern ACT4 corresponds to a portion overlapping with the fourth gate electrode GE4.

One end of the fourth source electrode SE4 may be connected to the fourth active pattern ACT4. The other end of the fourth source electrode SE4 may be connected to an initialization power line IPL of a pixel PXL on an (i−1)th row and a seventh drain electrode DE7 of a seventh transistor T7 of the pixel PXL on the (i−1)th row.

An auxiliary connection line AUX may be provided between the fourth source electrode SE4 and the initialization power line IPL. One end of the auxiliary connection line AUX may be connected to the fourth source electrode SE4 through a ninth contact hole CH9. The other end of the auxiliary connection line AUX may be connected to an initialization power line IPL on the (i−1)th row through an eighth contact hole CH8 of the pixel PXL on the (i−1)th row.

One end of the fourth drain electrode DE4 may be connected to the fourth active pattern ACT4. The other end of the fourth drain electrode DE4 may be connected to the third drain electrode DE3 of the third transistor T3. Also, the fourth drain electrode DE4 may be connected to the first gate electrode GE1 of the first transistor T1 through the second contact hole CH2 and the first contact hole CH1.

The fifth transistor T5 may include a fifth gate electrode GE5, a fifth active pattern ACT5, a fifth source electrode SE5, and the fifth drain electrode DE5.

The fifth gate electrode GE5 may be connected to the emission control line Ei. The fifth gate electrode GE5 may be provided as a portion of the emission control line Ei or may be provided in a shape protruding from the emission control line Ei.

The fifth active pattern ACT, the fifth source electrode SE5, and the fifth drain electrode DE5 may be formed of a semiconductor layer undoped or doped with an impurity. For example, the fifth source electrode SE5 and the fifth drain electrode DE5 may be formed of a semiconductor layer doped with the impurity, and the fifth active pattern ACT5 may be formed of a semiconductor layer undoped with the impurity. The fifth active pattern ACT5 corresponds to a portion overlapping with the fifth gate electrode GE5.

One end of the fifth source electrode SE5 may be connected to the fifth active pattern ACT5. The other end of the fifth source electrode SE5 may be connected to the power line PL through a fifth contact hole CH5. One end of the fifth drain electrode DE5 may be connected to the fifth active pattern ACT5. The other end of the fifth drain electrode DE5 may be connected to the first source electrode SE1 of the first transistor T1 and the second drain electrode DE2 of the second transistor T2.

The sixth transistor T6 may include a sixth gate electrode GE6, a sixth active pattern ACT6, the sixth source electrode SE6, and a sixth drain electrode DE6.

The sixth gate electrode SE6 may be connected to the emission control line Ei. The sixth gate electrode SE6 may be provided as a portion of the emission control line Ei or may be provided in a shape protruding from the emission control line Ei.

The sixth active pattern ACT6, the sixth source electrode SE6, and the sixth drain electrode DE6 may be formed of a semiconductor layer undoped or doped with an impurity. For example, the sixth source electrode SE6 and the sixth drain electrode DE6 may be formed of a semiconductor layer doped with the impurity, and the sixth active pattern ACT6 may be formed of a semiconductor layer undoped with the impurity. The sixth active pattern ACT6 corresponds to a portion overlapping with the sixth gate electrode GE6.

One end of the sixth source electrode SE6 may be connected to the sixth active pattern ACT6. The other end of the sixth source electrode SE6 may be connected to the first drain electrode DE1 of the first transistor T1 and the third source electrode SE3 of the third transistor T3. One end of the sixth drain electrode DE6 may be connected to the sixth active pattern ACT6. The other end of the sixth drain electrode DE6 may be connected to a seventh source electrode SE7 of the seventh transistor T7.

The seventh transistor T7 may include a seventh gate electrode GE7, a seventh active pattern ACT7, the seventh source electrode SE7, and a seventh drain electrode DE7.

The seventh gate electrode GE7 may be connected to the lower ith scan line Si. The seventh gate electrode GE7 may be provided as a portion of the lower ith scan line Si or may be provided in a shape protruding from the lower ith scan line Si.

The seventh active pattern ACT7, the seventh source electrode SE7, and the seventh drain electrode DE7 may be formed of a semiconductor layer undoped or doped with an impurity. For example, the seventh source electrode SE7 and the seventh drain electrode DE7 may be formed of a semiconductor layer doped with the impurity, and the seventh active layer ACT7 may be formed of a semiconductor layer undoped with the impurity. The seventh active pattern ACT7 corresponds to a portion overlapping with the seventh gate electrode GE7.

One end of the seventh source electrode SE7 may be connected to the seventh active pattern ACT7. The other end of the seventh source electrode SE7 may be connected to the sixth drain electrode DE6 of the sixth transistor T6.

One end of the seventh drain electrode DE7 may be connected to the seventh active pattern ACT7. The other end of the seventh drain electrode DE7 may be connected to the initialization power line IPL. Also, the seventh drain electrode DE7 may be connected to a fourth source electrode SE4 of a fourth transistor T4 of a pixel PXL on an (i+1)th row. The seventh drain electrode DE7 may be connected to the fourth source electrode SE4 of the fourth transistor T4 of the pixel PXL on the (i+1)th row through the auxiliary connection line AUX, the eighth contact hole CH8, and the ninth contact hole CH9.

The storage capacitor Cst may include a lower electrode LE and an upper electrode UE. The lower electrode LE may be configured as the first gate electrode GE1 of the first transistor T1.

The upper electrode UE overlaps with the first gate electrode GE1, and may cover the lower electrode LE when viewed on a plane. As the overlapping area of the upper electrode UE and the lower electrode LE is widened, the capacitance of the storage capacitor Cst may be increased. The upper electrode UE may extend in the first direction DR1.

In an embodiment of the present disclosure, a voltage having the same level as the first power source ELVDD may be applied to the upper electrode UE. The upper electrode UE may have an opening OPN in a region including the first contact hole CH1 through which the first gate electrode GE1 and the connection line CNL contact each other.

The light emitting device OLED may include a first electrode AD, a second electrode CD, and an emitting layer EML provided between the first electrode AD and the second electrode CD.

The first electrode AD may be provided in a light emitting region corresponding to each pixel PXL1. The first electrode AD may be connected to the seventh source electrode SE7 of the seventh transistor T7 and the sixth drain electrode DE6 of the sixth transistor T6 through a seventh contact hole CH7 and a tenth contact hole CH10.

A bridge pattern BRP may be provided between the seventh contact hole CH7 and the tenth contact hole CH10. The bridge pattern BRP may connect the sixth drain electrode DE6 and the seventh source electrode SE7 to the first electrode AD.

Herein, a structure of the display device according to an embodiment of the present disclosure will be described along a stacking order with reference to FIGS. 5 to 7.

The active pattern ACT1 to ACT7 (herein, referred to as ACT) may be provided on a substrate 100. The active pattern ACT may include the first to seventh active patterns ACT1 to ACT7. The first to seventh active patterns ACT1 to ACT7 may be formed of a semiconductor material.

A buffer layer (not shown) may be provided between the substrate 100 and the first to seventh active patterns ACT1 to ACT7.

A gate insulating layer GI may be provided on the substrate 100 on which the first to seventh active patterns ACT1 to ACT7 are formed.

The (i−1)th scan line Si−1, the ith scan line Si, the emission control line Ei, and the first to seventh gate electrodes GE1 to GE7 may be provided on the gate insulating layer GI.

The first gate electrode GE1 may become the lower electrode LE of the storage capacitor Cst. The second gate electrode GE2 and the third gate electrode GE3 may be integrally formed with the upper ith scan line Si. The fourth gate electrode GE4 may be integrally formed with the (i−1)th scan line Si−1. The fifth gate electrode GE5 and the sixth gate electrode GE6 may be integrally formed with the emission control line Ei. The seventh gate electrode GE7 may be integrally formed with the lower ith scan line Si.

A first interlayer insulating layer IL1 may be provided on the substrate 100 on which the (i−1)th scan line Si−1 and the like are formed.

The upper electrode UE of the storage capacitor Cst and the initialization power line IPL may be provided on the first interlayer insulating layer IL1. The upper electrode UE may cover the lower electrode LE. The upper electrode UE along with the lower electrode LE may constitute the storage capacitor Cst with the first interlayer insulating layer IL1 interposed therebetween.

A second interlayer insulating layer IL2 may be provided on the substrate 100 on which the upper electrode UE and the initialization power line IPL are disposed.

The data line Dj, the power line PL, the connection line CNL, the auxiliary connection line AUX, and the bridge pattern BRP may be provided on the second interlayer insulating layer IL2.

The data line Dj may be connected to the second source electrode SE2 through the sixth contact hole CH6 passing through the first interlayer insulating layer IL1, the second interlayer insulating layer IL2, and the gate insulating layer GI.

The power line PL may be connected to the upper electrode UE of the storage capacitor Cst through the third and fourth contact holes CH3 and CH4 passing through the second interlayer insulating layer IL2.

The power line PL may be connected to the fifth source electrode SE5 through the fifth contact hole CH5 passing through the first interlayer insulating layer IL1, the second interlayer insulating layer IL2, and the gate insulating layer GI.

The connection line CNL may be connected to the first gate electrode GE1 through the first contact hole CH1 passing through the first interlayer insulating layer IL1 and the second interlayer insulating layer IL2. Also, the connection line CNL may be connected to the third drain electrode DE3 and the fourth drain electrode DE4 through the second contact hole CH2 passing through the gate insulating layer GI, the first interlayer insulating layer IL1, and the second interlayer insulating layer IL2.

The auxiliary connection line AUX may be connected to the initialization power line IPL through the eighth contact hole CH8 passing through the second interlayer insulating layer IL2. Also, the auxiliary connection line AUX may be connected to the fourth source electrode SE4 and the seventh drain electrode DE7 of the pixel PXL on the (i−1)th row through the ninth contact hole CH9 passing through the gate insulating layer GI, the first interlayer insulating layer IL1, and the second interlayer insulating layer IL2.

The bridge pattern BRP may be a pattern provided as a medium connecting the sixth drain electrode DE6 to the first electrode AD between the sixth drain electrode DE6 and the first electrode AD. The bridge pattern BRP may be connected to the sixth drain electrode DE6 and the seventh source electrode SE7 through the seventh contact hole CH7 passing through the gate insulating layer GI, the first interlayer insulating layer IL1, and the second interlayer insulating layer IL2.

A protective layer PSV may be provided on the substrate 100 on which the data line Dj and the like are formed.

The light emitting device OLED may be provided on the protective layer PSV. The light emitting device OLED may include the first electrode AD, the second electrode CD, and the emitting layer EML provided between the first electrode AD and the second electrode CD.

The first electrode AD may be provided on the protective layer PSV. The first electrode AD may be connected to the bridge pattern BRP through the tenth contact hole CH10 passing through the protective layer PSV. Since the bridge pattern BRP is connected to the sixth drain electrode DE6 and the seventh source electrode SE7 through the seventh contact hole CH7, the first electrode AD can be finally connected to the sixth drain electrode DE6 and the seventh source electrode SE7.

A pixel defining layer PDL defining a light emitting region to correspond to each pixel PXL1 may be provided on the substrate 100 on which the first electrode AD and the like are formed. The pixel defining layer PDL may expose a top surface of the first electrode AD therethrough and protrude from the substrate 100 along the circumference of the pixel PXL1.

The emitting layer EML may be provided in the light emitting region surrounded by the pixel defining layer PDL, and the second electrode CD may be provided on the emitting layer EML. An encapsulation layer SLM covering the second electrode CD may be provided on the second electrode CD.

One of the first electrode AD and the second electrode CD may be an anode electrode, and the other of the first electrode AD and the second electrode CD may be a cathode electrode. For example, the first electrode AD may be an anode electrode, and the second electrode CD may be a cathode electrode.

In addition, at least one of the first electrode AD and the second electrode CD may be a transmissive electrode. For example, when the light emitting device OLED is a bottom-emission organic light emitting device, the first electrode AD may be a transmissive electrode, and the second electrode CD may be a reflective electrode.

When the light emitting device OLED is a top-emission organic light emitting device, the first electrode AD may be a reflective electrode, and the second electrode CD may be a transmissive electrode.

When the light emitting device OLED is a dual-emission light emitting device, both of the first electrode AD and the second electrode CD may be transmissive electrodes.

In the present embodiment, a case in which the light emitting device OLED is a top-emission organic light emitting device and the first electrode AD is an anode electrode is described as an example.

The first electrode AD may include a reflective layer (not shown) capable of reflecting light and a transparent conductive layer (not shown) disposed over or under the reflective layer. At least one of the transparent conductive layer and the reflective layer may be connected to the sixth drain electrode DE6.

The reflective layer may include a material capable of reflecting light. For example, the reflective layer may include at least one selected from the group consisting of aluminum (Al), silver (Ag), chromium (Cr), molybdenum (Mo), platinum (Pt), nickel (Ni), and alloys thereof.

The transparent conductive layer may include a transparent conductive oxide. For example, the transparent conductive layer may include at least one transparent conductive oxide selected from indium tin oxide (ITO), indium zinc oxide (IZO), aluminum zinc oxide (AZO), gallium doped zinc oxide (GZO), zinc tin oxide (ZTO), gallium tin oxide (GTO), and fluorine doped tin oxide (FTO).

The pixel defining layer PDL may include an organic insulating material. For example, the pixel defining layer PDL may include at least one of polystyrene, polymethyl methacrylate (PMMA), polyacrylonitrile (PAN), polyamide (PA), polyimide (PI), polyarylether (PAE), heterocyclic polymer, parylene, epoxy, benzocyclobutene (BCB), siloxane based resin, and silane based resin.

The emitting layer EML may be disposed on the exposed surface of the first electrode AD. The emitting layer EML may have a multi-layered thin film structure at least including a light generation layer (LGL).

The second electrode CD may be a semi-transmissive reflective layer. For example, the second electrode CD may be a thin metal layer having a thickness, through which light emitted through the emitting layer EML can be transmitted. The second electrode CD may transmit a portion of the light emitted from the emitting layer EML therethrough, and may reflect the rest of the light emitted from the emitting layer EML.

The encapsulation layer SLM may prevent or substantially prevent oxygen and moisture from infiltrating into the light emitting device OLED. In an embodiment, the encapsulation layer SLM may include a plurality of inorganic layers (not shown) and a plurality of organic layers (not shown). For example, the encapsulation layer SLM may include a plurality of encapsulation layers including the inorganic layer and the organic layer disposed on the inorganic layer. In addition, the inorganic layer may be disposed at an uppermost portion of the encapsulation layer SLM. The inorganic layer may include at least one selected from the group consisting of silicon oxide, silicon nitride, silicon oxynitride, aluminum oxide, titanium oxide, zirconium oxide, and tin oxide.

Although a configuration of the first pixel PXL1 is exemplarily illustrated in FIGS. 4 to 7, the second pixel PXL2 and the third pixel PXL3 may also be formed to have the same configuration as the first pixel PXL1.

Figure 8:
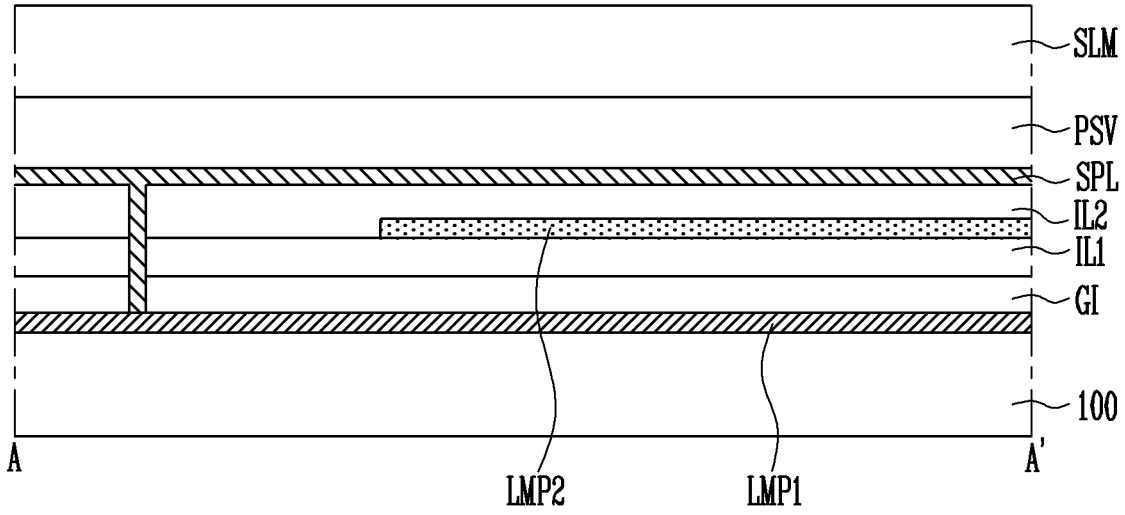
FIG. 8 is a cross-sectional view taken along the line A-A' of FIG. 2.

FIG. 8 is a cross-sectional view taken along line A-A' of FIG. 2.

Referring to FIGS. 2 to 8, each of the first load matching unit LMU1 may include a first load matching pattern LMP1 and a second load matching pattern LMP2.

In an embodiment, the first load matching pattern LMP1 may be formed of a same material through a same process as the first to seventh active patterns ACT1 to ACT7, the first to seventh source patterns SE1 to SE7, and the first to seventh drain patterns DE1 to DE7 of the pixels PXL1, PXL2, and PXL3.

That is, in an embodiment, the first load matching pattern LMP1 may be provided on a same layer as the first to seventh active patterns ACT1 to ACT7, the first to seventh source patterns SE1 to SE7, and the first to seventh drain patterns DE1 to DE7.

In an embodiment, the second load matching pattern LMP2 is provided on the first interlayer insulating layer IL1, and may be formed of a same material through a same process as the upper electrode UE of the storage capacitor Cst of the pixels PXL1, PXL2, and PXL3 and the initialization power line IPL.

When viewed on a plane, the first load matching pattern LMP1 and the second load matching pattern LMP2 may overlap with each other such that a capacitance is formed between the first load matching pattern LMP1 and the second load matching pattern LMP2. That is, the first load matching pattern LMP1 and the second load matching pattern LMP2 may form a capacitor.

An auxiliary power line SPL may be provided on the second interlayer insulating layer IL2. In an embodiment, the auxiliary power line SPL may be formed of a same material through a same process as the data line Dj of the pixels PXL1, PXL2, and PXL3, the power line PL, the connection line CNL, and the like.

The auxiliary power line SPL may be applied with the first power source ELVDD or the second power source ELVSS. That is, the auxiliary power line SPL may function to apply a reference potential to the capacitor.

The capacitor can increase the load value of the second scan line S21 to S26. Thus, it is possible to reduce a difference in load value between the first scan line S11 to S1*k* and the second scan line S21 to S26.

In an embodiment, a configuration of each of the second and third load matching units LMU2 and LMU3 may be the same as that of the first load matching unit LMU1.

However, the capacitor is weak to static electricity. Specifically, the static electricity may be input through the second load matching pattern LMP2. The static electricity may have an influence on the threshold voltage of the transistors provided in the pixels PXL2 and PXL3 connected to the load matching units LMU1, LMU2, and LMU3.

When the threshold voltage of the transistors provided in the first pixels PXL1 and the threshold voltage of the transistors provided in the pixels PXL2 and PXL3 are different from each other, there may occur a difference in luminance between an image displayed in the first pixel region AA1 and an image displayed in the second pixel region AA2 and the third pixel region AA3.

Referring to FIG. 2, in order to protect the pixels PXL2 and PXL3 from the static electricity, protection lines 510*a* and 510*b* may be provided between the load matching units LMU1, LMU2, and LMU3 and the pixels PXL2 and PXL3.

The protection lines 510*a* and 510*b* may include first protection lines 510*a* electrically connected to the second pixels PXL2 and second protection lines 510*b* electrically connected to the third pixels PXL3.

The protection lines 510*a* and 510*b* may be located in the second peripheral region NA2, the third peripheral region NA3, and the fourth peripheral region NA4.

Ends of the protection lines 510*a* and 510*b* may be electrically connected to the load matching units LMU1, LMU2, and LMU3, and other ends of the protection lines 510*a* and 510*b* may be connected to the scan lines S21 to S26 and S31 to S36 connected to the pixels PXL2 and PXL3.

The protection lines 510*a* and 510*b* may be formed of poly-silicon such that the resistance of the protection lines 510*a* and 510*b* increases.

In an embodiment, the protection lines 510*a* and 510*b* may be formed in a same layer as the first load matching pattern LMP1.

Figure 9:
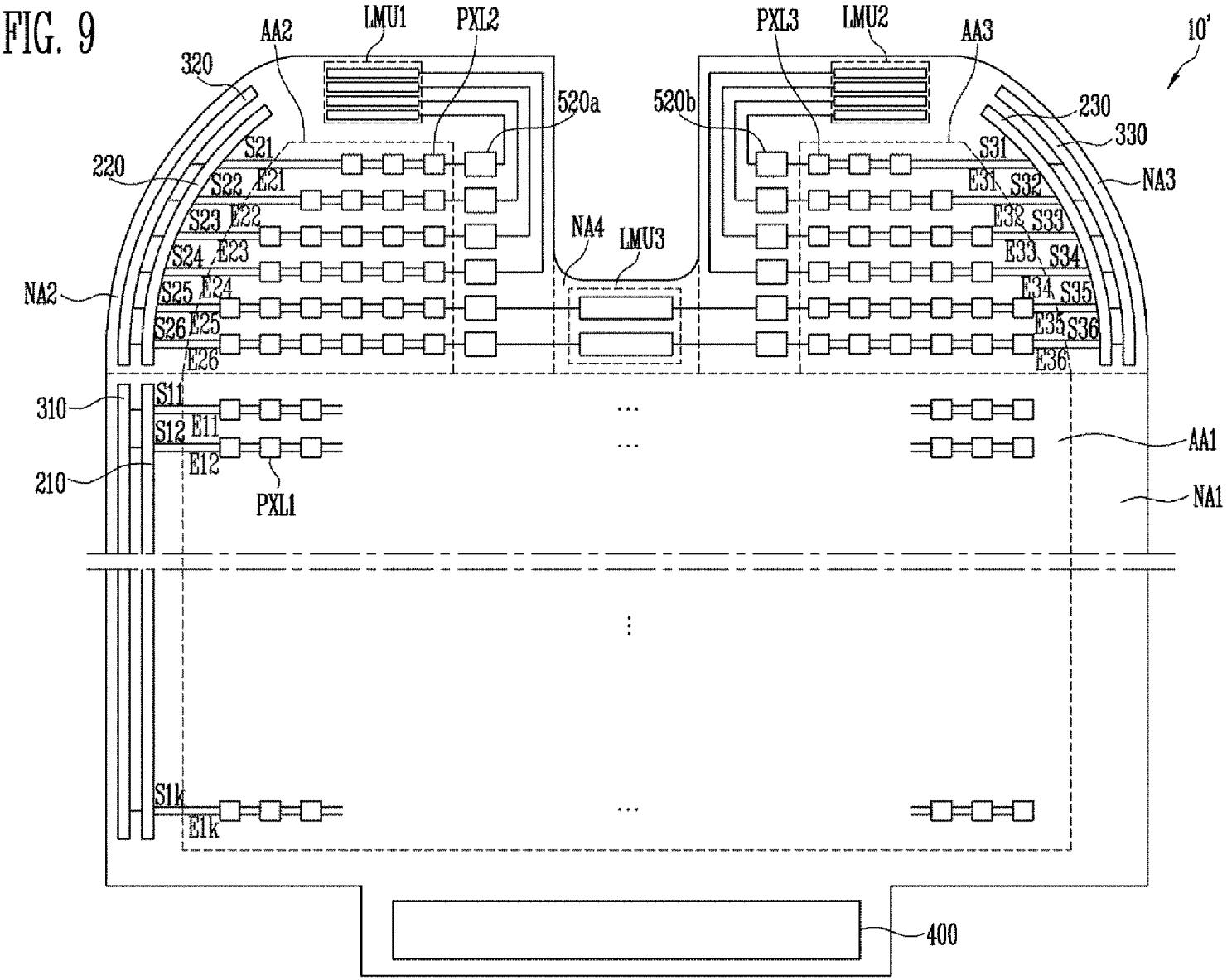
FIG. 9 is a view illustrating a display device according to another embodiment of the present disclosure.

FIG. 9 is a view illustrating a display device according to another embodiment of the present disclosure.

In FIG. 9, portions different from those of the above-described embodiment (e.g., FIG. 2) will be mainly described, and descriptions overlapping with the above-described embodiment will be omitted. Accordingly, a protection unit will be mainly described.

Referring to FIG. 9, the protection unit may include electrostatic discharge protection circuits 520*a* and 520*b*.

The electrostatic discharge protection circuits 520*a* and 520*b* may include first electrostatic discharge protection circuits 520*a* electrically connected to the second pixels PXL2 and second electrostatic discharge protection circuits 520*b* electrically connected to the third pixels PXL3.

The electrostatic discharge protection circuits 520*a* and 520*b* may be located in the second peripheral region NA2, the third peripheral region NA3, and the fourth peripheral region NA4.

The electrostatic discharge protection circuits 520*a* and 520*b* may be provided between the load matching units LMU1, LMU2, and LMU3 and the pixels PXL2 and PXL3.

Input ends of the electrostatic discharge protection circuits 520*a* and 520*b* may be electrically connected to the load matching units LMU1, LMU2, and LMU3, and output ends of the electrostatic discharge protection circuits 520*a* and 520*b* may be connected to the scan lines S21 to S26 and S31 to S36 connected to the pixels PXL2 and PXL3.

Figure 10:
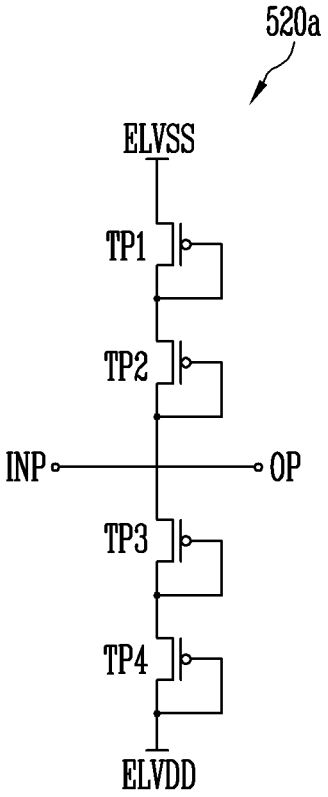
FIG. 10 is a view illustrating a configuration of an electrostatic discharge protection circuit shown in FIG. 9, according to an embodiment of the present disclosure.

FIG. 10 is a view illustrating a configuration of the first electrostatic discharge protection circuit shown in FIG. 9, according to an embodiment of the present disclosure.

Referring to FIG. 10, the first electrostatic discharge protection circuit 520*a* may include a first protection transistor TP1, a second protection transistor TP2, a third protection transistor TP3, and a fourth protection transistor TP4.

Each of the first protection transistor TP1, the second protection transistor TP2, the third protection transistor TP3, and the fourth protection transistor TP4 may include a gate electrode, a first electrode, and a second electrode.

The gate electrode may be connected to the first electrode. Therefore, each of the first protection transistor TP1, the second protection transistor TP2, the third protection transistor TP3, and the fourth protection transistor TP4 may be configured as a transistor that is diode-connected in a reverse direction.

In order to drive the first protection transistor TP1, the second protection transistor TP2, the third protection transistor TP3, and the fourth protection transistor TP4, the first electrostatic discharge protection circuit 520*a* may be supplied with the first power source ELVDD that is a high-potential driving power source and the second power source ELVSS that is a low-potential driving power source.

That the transistor is diode-connected in the reverse direction is described based on a normal state, i.e. a case in which a driving power source, a driving signal, and the like are input. When positive or negative static electricity having a large absolute value is input, the transistor may be diode-connected in a forward direction with respect to the static electricity.

That is, in static electricity having a large magnitude of voltage (i.e. a large absolute value of voltage), static electricity having a positive (+) value may be induced toward the first power source ELVDD, and static electricity having a negative (−) value may be induced toward the second power source ELVSS. Thus, the static electricity is not applied to the transistors in the pixels PXL1, PXL2, and PXL3.

Although not shown in the drawings, the second electrostatic discharge protection circuit 520*b* may be formed to have a same configuration as the first electrostatic discharge protection circuit 520*a*.

Figure 11:
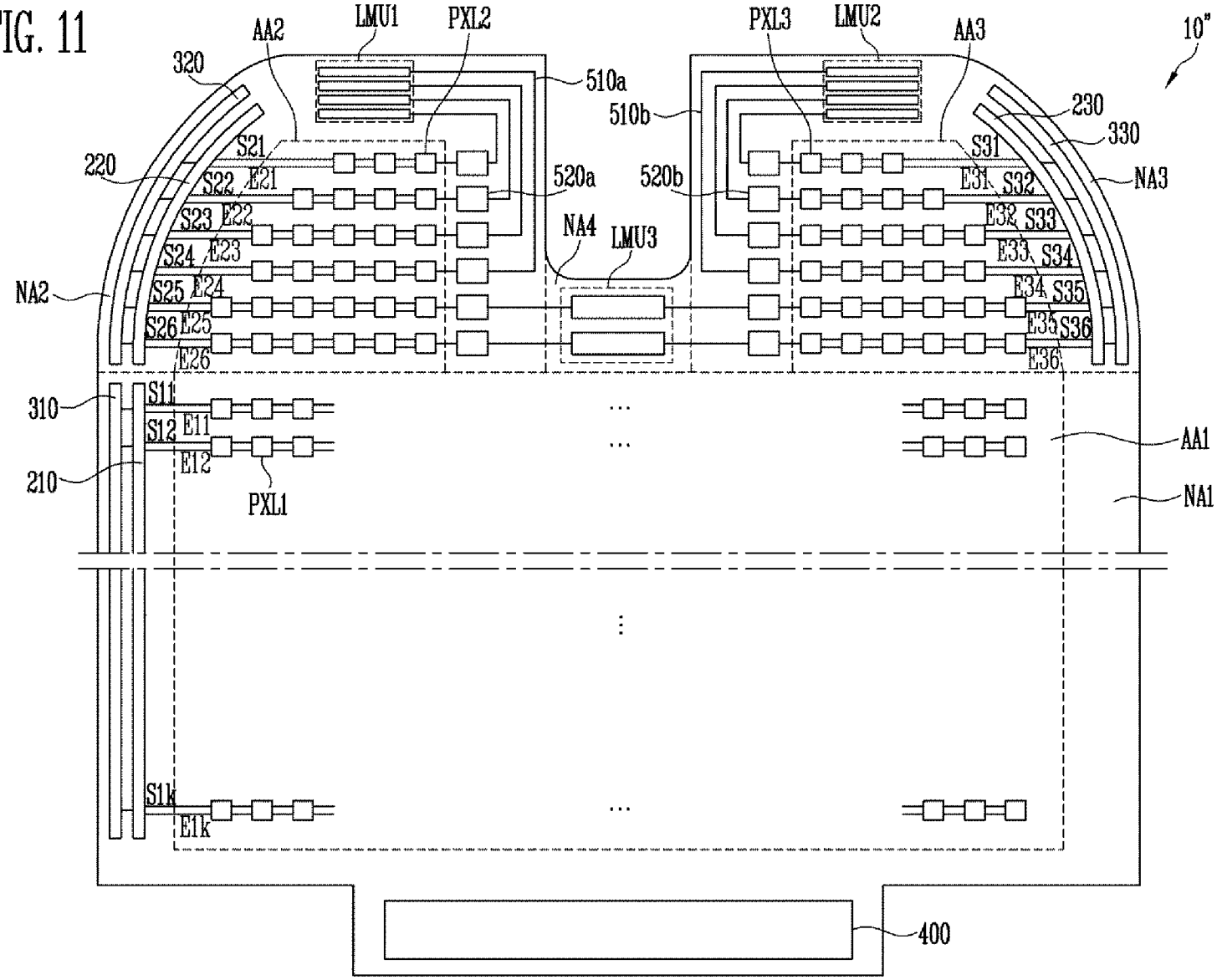
FIG. 11 is a view illustrating a display device according to another embodiment of the present disclosure.

FIG. 11 is a view illustrating a display device according to another embodiment of the present disclosure.

In FIG. 11, portions different from those of the above-described embodiments (e.g., FIGS. 2 and 9) will be mainly described, and descriptions overlapping with the above-described embodiment will be omitted. Accordingly, a protection unit will be mainly described.

Referring to FIG. 11, the protection unit may include protection lines 510*a* and 510*b* and electrostatic discharge protection circuits 520*a* and 520*b*.

The protection lines 510*a* and 510*b* and the electrostatic discharge protection circuits 520*a* and 520*b* may be located in the second peripheral region NA2, the third peripheral region NA3, and the fourth peripheral region NA4.

Ends of the protection lines 510*a* and 510*b* may be electrically connected to the load matching units LMU1, LMU2, and LMU3, and other ends of the protection lines 510*a* and 510*b* may be connected to input ends of the electrostatic discharge protection circuits 520*a* and 520*b*.

Output ends of the electrostatic discharge protection circuits 520*a* and 520*b* may be connected to the scan lines S21 to S26 and S31 to S36 connected to the pixels PXL2 and PXL3.

According to an aspect of the present disclosure, it is possible to provide a display device capable of displaying an image with a uniform luminance.

Further, according to an aspect of the present disclosure, it is possible to provide a display device capable of efficiently using dead spaces.

Further, according to an aspect of the present disclosure, it is possible to provide a display device protected from electrostatic discharge.

Some example embodiments have been disclosed herein, and although specific terms are employed, they are used and are to be interpreted in a generic and descriptive sense only and not for purposes of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims.

What is claimed is:

1. A display device comprising:

first pixels in a first pixel region, the first pixels being connected to first scan lines;

second pixels in a second pixel region that is located at a side of the first pixel region and has a width smaller than a width of the first pixel region, the second pixels being connected to second scan lines;

third pixels in a third pixel region that is spaced apart from the second pixel region and has a width smaller than the width of the first pixel region, the third pixels being connected to third scan lines;

a load matching unit in a peripheral region at an outside of the second pixel region and the third pixel region, the load matching unit configured to match loads of the second scan lines and the third scan lines to that of the first scan lines; and a protection unit in the peripheral region, the protection unit being connected between the second and third pixels and the load matching unit, wherein the protection unit includes first protection lines and second protection lines, and wherein the load matching unit includes a first load matching pattern and a second load matching pattern, which form a capacitor, and a power line to apply a reference potential to the capacitor.

2. The display device of claim 1, further comprising:

a first scan driver in a first peripheral region at an outside of the first pixel region, the first scan driver configured to supply a first scan signal to the first scan lines;

a second scan driver in a second peripheral region at the outside of the second pixel region, the second scan driver configured to supply a second scan signal to the second scan lines; and a third scan driver in a third peripheral region at an outside of the third pixel region, the third scan driver configured to supply a third scan signal to the third scan lines, wherein the second pixels are connected between the second scan driver and the load matching unit, and the third pixels are connected between the third scan driver and the load matching unit.

3. The display device of claim 1, wherein the first protection lines and the second protection lines include polysilicon.

4. The display device of claim 1, wherein a number of the second pixels located on one horizontal line and a number of the third pixels located on one horizontal line become smaller at locations more distant from the first pixel region.

5. A display device comprising:

first pixels in a first pixel region, the first pixels being connected to first scan lines;

second pixels in a second pixel region that is located at a side of the first pixel region and has a width smaller than a width of the first pixel region, the second pixels being connected to second scan lines;

third pixels in a third pixel region that is spaced apart from the second pixel region and has a width smaller than the width of the first pixel region, the third pixels being connected to third scan lines;

a load matching unit in a peripheral region at an outside of the second pixel region and the third pixel region, the load matching unit configured to match loads of the second scan lines and the third scan lines to that of the first scan lines; and a protection unit in the peripheral region, the protection unit being connected between the second and third pixels and the load matching unit, wherein the protection unit includes first protection lines and second protection lines, the display device further comprising:

a first scan driver in a first peripheral region at an outside of the first pixel region, the first scan driver configured to supply a first scan signal to the first scan lines;

a second scan driver in a second peripheral region at the outside of the second pixel region, the second scan driver configured to supply a second scan signal to the second scan lines; and a third scan driver in a third peripheral region at an outside of the third pixel region, the third scan driver configured to supply a third scan signal to the third scan lines, wherein the second pixels are connected between the second scan driver and the load matching unit, and the third pixels are connected between the third scan driver and the load matching unit, and wherein the load matching unit includes:

first load matching units in the second peripheral region, the first load matching units being electrically connected to some of the second scan lines;

second load matching units in the third peripheral region, the second load matching units being electrically connected to some of the third scan lines; and third load matching units in a fourth peripheral region connecting the second peripheral region and the third peripheral region, the third load matching units being electrically connected to other ones of the second scan lines and other ones of the third scan lines.

6. The display device of claim 5, wherein some of the first protection lines are between the first load matching units and the second pixels, and other ones of the first protection lines are between the third load matching units and the second pixels.

7. The display device of claim 6, wherein some of the second protection lines are between the second load matching units and the third pixels, and other ones of the second protection lines are between the third load matching units and the third pixels.

8. A display device comprising:

first pixels in a first pixel region, the first pixels being connected to first scan lines;

second pixels in a second pixel region that is located at a side of the first pixel region and has a width smaller than a width of the first pixel region, the second pixels being connected to second scan lines;

third pixels in a third pixel region that is spaced apart from the second pixel region and has a width smaller than the width of the first pixel region, the third pixels being connected to third scan lines;

a load matching unit in a peripheral region at an outside of the second pixel region and the third pixel region, the load matching unit configured to match loads of the second scan lines and the third scan lines to that of the first scan lines; and a protection unit in the peripheral region, the protection unit being connected between the second and third pixels and the load matching unit, wherein the protection unit includes first protection lines and second protection lines, wherein a number of the second pixels located on one horizontal line and a number of the third pixels located on one horizontal line become smaller at locations more distant from the first pixel region, wherein the load matching unit includes a first load matching pattern and a second load matching pattern, which form a capacitance therebetween, and wherein a magnitude of the capacitance becomes larger at locations more distant from the first pixel region.

9. A display device comprising:

first pixels in a first pixel region, the first pixels being connected to first scan lines;

second pixels in a second pixel region that is located at a side of the first pixel region and has a width smaller than a width of the first pixel region, the second pixels being connected to second scan lines;

third pixels in a third pixel region that is spaced apart from the second pixel region and has a width smaller than the width of the first pixel region, the third pixels being connected to third scan lines;

a load matching unit located in a peripheral region at an outside of the second pixel region and the third pixel region, the load matching unit configured to match loads of the second scan lines and the third scan lines to that of the first scan lines; and a protection unit in the peripheral region, the protection unit being connected between the second pixels and the load matching unit, the protection unit being connected between the third pixels and the load matching unit, wherein the protection unit includes electrostatic discharge protection circuits, and wherein the load matching unit includes a first load matching pattern and a second load matching pattern, which form a capacitor, and a power line to apply a reference potential to the capacitor.

10. The display device of claim 9, wherein the electrostatic discharge protection circuits include first electrostatic discharge protection circuits electrically connected to the second pixels and second electrostatic discharge protection circuits electrically connected to the third pixels.

11. A display device comprising:

first pixels in a first pixel region, the first pixels being connected to first scan lines;

second pixels in a second pixel region that is located at a side of the first pixel region and has a width smaller than a width of the first pixel region, the second pixels being connected to second scan lines;

third pixels in a third pixel region that is spaced apart from the second pixel region and has a width smaller than the width of the first pixel region, the third pixels being connected to third scan lines;

a load matching unit located in a peripheral region at an outside of the second pixel region and the third pixel region, the load matching unit configured to match loads of the second scan lines and the third scan lines to that of the first scan lines; and a protection unit in the peripheral region, the protection unit being connected between the second pixels and the load matching unit, the protection unit being connected between the third pixels and the load matching unit, wherein the protection unit includes electrostatic discharge protection circuits, wherein the electrostatic discharge protection circuits include first electrostatic discharge protection circuits electrically connected to the second pixels and second electrostatic discharge protection circuits electrically connected to the third pixels, and wherein each of the first electrostatic discharge protection circuits and the second electrostatic discharge protection circuits includes reverse diode type transistors each including a gate electrode and a first electrode, which are connected to each other.

12. The display device of claim 11, wherein the load matching unit includes:

first load matching units in the second peripheral region, the first load matching units being electrically connected to some of the second scan lines;

second load matching units in the third peripheral region, the second load matching units being electrically connected to some of the third scan lines; and third load matching units in a fourth peripheral region connecting the second peripheral region and the third peripheral region, the third load matching units being electrically connected to other ones of the second scan lines and other ones of the third scan lines.

13. The display device of claim 12, wherein some of the first electrostatic discharge protection circuits are connected to the first load matching units, and other ones of the first electrostatic discharge protection circuits are connected to the third load matching units.

14. The display device of claim 13, wherein some of the second electrostatic discharge protection circuits are connected to the second load matching units, and other ones of the second electrostatic discharge protection circuits are connected to the third load matching units.

15. The display device of claim 14, wherein the protection unit further includes:

first protection lines electrically connected to the first electrostatic discharge protection circuits; and second protection lines electrically connected to the second electrostatic discharge protection circuits.

16. The display device of claim 15, wherein some of the first protection lines are between the first load matching units and the second pixels, and other ones of the first protection lines are between the third load matching units and the second pixels, and wherein some of the second protection lines are between the second load matching units and the third pixels, and other ones of the second protection lines are between the third load matching units and the third pixels.

17. The display device of claim 15, wherein the first protection lines and the second protection lines include poly-silicon.

* * * * *